US005441603A

United States Patent [19]

Griggs et al.

[11] Patent Number: 5,441,603

[45] Date of Patent: * Aug. 15, 1995

[54] METHOD FOR CHELATION OF PULP PRIOR TO OZONE DELIGNIFICATION

[75] Inventors: Bruce F. Griggs, Columbia, S.C.; Thomas P. Gandek, Trenton, N.J.; Michael A. Pikulin, Bound Brook, N.J.; Allen Rosen, Lawrenceville, N.J.

[73] Assignee: Union Camp Patent Holding, Inc., Princeton, N.J.

[ * ] Notice: The portion of the term of this pat/ent subsequent to Nov. 19, 2009 is disclaimed.

[21] Appl. No.: 97,699

[22] Filed: Jul. 27, 1993

Related U.S. Application Data

[63] Continuation of Ser. No. 896,481, Jun. 2, 1992, which is a continuation of Ser. No. 525,808, May 2, 1990, abandoned.

[51] Int. Cl.[6] ..... D21C 9/153

[52] U.S. Cl. ..... 162/57; 162/56; 162/65

[58] Field of Search ..... 162/60, 65, 19, 40, 162/56, 57, 37, 39, 18, 88, 89, 90, 72, 76, 78

[56] References Cited

U.S. PATENT DOCUMENTS

| | | | |
|---|---|---|---|
| 1,591,070 | 7/1926 | Wolf . | |
| 3,318,657 | 5/1967 | Wade | 8/111 |
| 3,451,888 | 6/1969 | Ancelle et al. | 162/65 |
| 3,652,388 | 3/1972 | Croon et al. | 162/65 |
| 3,660,225 | 5/1972 | Verreyne et al. | 162/17 |
| 3,663,357 | 5/1972 | Liebergott | 162/65 |
| 3,703,435 | 11/1972 | Schleinofer | 162/17 |
| 3,725,193 | 4/1973 | De Montigny | 162/17 |
| 3,759,783 | 9/1973 | Samuelson et al. | 162/40 |
| 3,785,577 | 1/1974 | Carlsmith | 241/57 |
| 3,814,664 | 6/1974 | Carlsmith | 162/236 |
| 3,832,273 | 8/1974 | Roymoulik et al. | 162/65 |
| 3,874,992 | 4/1975 | Liebergott | 162/66 |
| 3,888,727 | 6/1975 | Kenig | 162/65 |
| 3,926,798 | 12/1975 | Cadotte | 210/23 |
| 3,964,962 | 6/1976 | Carlsmith | 162/236 |
| 4,046,621 | 9/1977 | Sexton | 162/40 |
| 4,080,249 | 3/1978 | Kempf et al. | 162/57 |
| 4,089,737 | 5/1978 | Nagano et al. | 162/19 |
| 4,119,486 | 10/1978 | Eckert | 162/65 |

(List continued on next page.)

FOREIGN PATENT DOCUMENTS

| | | |
|---|---|---|
| 966604 | 4/1975 | Canada . |
| 970111 | 7/1975 | Canada . |
| 1103409 | 6/1981 | Canada . |

(List continued on next page.)

OTHER PUBLICATIONS

Soteland, "Bleaching of Chem. Pulps with Oxygen & Ozone" Pulp & Paper of Canada, pp. 91–96 Apr. 1974.

Schleinkofer, "Overview of A Chlorine-Free Bleaching Process", 1981 Oxidative Bleaching Conf.; Denver Oct. 22, 1981.

(List continued on next page.)

*Primary Examiner*—Steve Alvo

*Attorney, Agent, or Firm*—Pennie & Edmonds

[57] ABSTRACT

A process for delignifying and bleaching a lignocellulosic pulp without the use of elemental chlorine by partially delignifying the pulp to a K No. of about 10 or less and a viscosity of greater than about 13 cps; and further delignifying the partially delignified pulp with an effective amount of ozone for a sufficient time to obtain a substantially delignified pulp having a K No. of about 5 or less, a viscosity of greater than about 10, and a GE brightness of at least about 50%. The substantially delignified pulp may be brightened by the addition of a bleaching agent such as chlorine dioxide or a peroxide to obtain a final product having a GE brightness of at least about 65%, preferably above 70% to as high as 90%. Because of the absence of elemental chlorine in this sequence, filtrate from all stages but the chlorine dioxide stage (if used) can be recovered without sewering. Major environmental improvements are thus achieved.

22 Claims, 4 Drawing Sheets

U.S. PATENT DOCUMENTS

| | | | |
|---|---|---|---|
| 4,123,317 | 10/1978 | Fritzvold et al. | 162/17 |
| 4,155,806 | 5/1979 | Mannbro | 162/19 |
| 4,155,845 | 5/1979 | Ancelle et al. | 210/22 R |
| 4,198,266 | 4/1980 | Kirk et al. | 162/29 |
| 4,216,054 | 8/1980 | Bentvelzen | 162/57 |
| 4,220,498 | 9/1980 | Prough | 162/25 |
| 4,226,673 | 10/1980 | Fremont | 162/29 |
| 4,229,252 | 10/1980 | Meredith | 162/65 |
| 4,268,350 | 5/1981 | Mansson | 162/29 |
| 4,274,913 | 6/1981 | Kikuiti et al. | 162/65 |
| 4,278,496 | 7/1981 | Fritzvold | 162/19 |
| 4,283,251 | 8/1981 | Singh | 162/17 |
| 4,295,925 | 10/1981 | Bentvelzen et al. | 162/19 |
| 4,295,926 | 10/1981 | Bentvelzen et al. | 162/57 |
| 4,298,427 | 11/1981 | Bentvelzen et al. | 162/57 |
| 4,363,697 | 12/1982 | Markham et al. | 162/19 |
| 4,372,812 | 2/1983 | Phillips et al. | 162/65 |
| 4,384,920 | 5/1983 | Markham et al. | 162/19 |

(List continued on next page.)

FOREIGN PATENT DOCUMENTS

| | | |
|---|---|---|
| 1112813 | 11/1981 | Canada . |
| 1119360 | 3/1982 | Canada . |
| 1154205 | 9/1983 | Canada . |
| 1181204 | 1/1985 | Canada . |
| 1186105 | 4/1985 | Canada . |

(List continued on next page.)

OTHER PUBLICATIONS

Soteland, Bleaching of Chemical Pulps with Oxygen and Ozone, Pulp and Paper Magazine of Canada, vol. 75, No. 4, Apr. 1974 pp. 91–95.

Dow Chemical Co., "Keys to Chelation" (1985).

Allison, Effects of Temperature and Chemical Pretretment on Pulp Bleaching with Ozone, 1985 Int'l Pulping Conference pp. 47–53.

Smith, The Sequestration of Metals, Macmillan, New York 1959 pp. 54–69.

McDonough, "Oxygen Bleaching's Pace Quickens", IPC Technical Paper Series, No. 246 (Jul. 1987).

Geiger, "Mechanisms of Bleach with Oxygen-Containing Species", ISWPC, (1987).

Lindholm, "Effect of Heterogeneity in Pulp Bleaching with Ozone", Paperi ja Puu, (Apr. 1987).

Lindholm, "Effect of Pulp Consistency and pH in Ozone Bleaching", Paperi ja Puu, (Mar. 1987).

Lindholm "Effect of Pulp Consistency and pH in Ozone Bleaching: Part 2", International Oxygen Delignification Conference (1987).

Hill and Rice, "Handbook of Ozone Technology and Applications", Ann Arbor Science.

Eriksson and Gierer, "Ozonation of Residual Lignin".

Article, "Naco Straw Pulp", PPI, (Apr. 1987).

Norden and Simonson, "Ozone Bleaching of Sulphite Pulp—A Pilot Plant Study".

Germgard and Sjogren, "Ozone Prebleaching of a Modified-Cooked and Oxygen-Bleached Softwood Kraft Pulp", Svensk Papperstidning, No. 15, (1985).

Schuerch, "Ozonization of Cellulose and Wood, Journal of Polymer Science", No. 2, (1963).

Vidal and Holinier, "Ozonolysis of Lignin—Improvement of In Vitro Digestibility of Poplar Sawdust", Biomass 16, (1988).

Godsay and Pearce, "Physico-Chemical Properties of Ozone Oxidized Kraft Pulps", Oxygen Delignification (1984).

Gangolli, "The Use of Ozone and Pulp in the Paper Industry".

Gregor and Gregor, "Synthetic-Membrane Technology", Scientific American, (Jul. 1970).

Britt, "Pulp and Paper Technology".

Germgard, "Chlorate Discharge from Bleach Plants—How to Handle a Potential Environmental Problem", Paperi ja Puu, V. 71, No. 3, (1989).

Singh "The Bleaching of Pulp", Tappi Press, 3rd Edition.

Reeve and Earl, "Chlorinated Organic Matter in Bleached Chemical Pulp Production Part 1: Environment Impact and Regulations of Effluents, Pulp and Paper Canada", 90:4, (1989).

Brannland and Fossin, "How to Cope With TOCL", International Oxygen Delignification Conference, (1987).

Andtbacka, "Low Kappa Pulping Followed by Oxygen Delignification", Appita, vol. 39, No. 2, (1986).

Talka and Priha, "Fractionation and Identification of Some Biologically Active Compounds in Bleached Kraft Mill Effluents", Paperi ja Puu (1987).

Jamieson and Smedman, "Integration of Oxygen Bleaching in the Brown Stock Washing System", Svensk Papperstidning (1973).

Germgard et al., "Mathematical Models for Simulation (List continued on next page.)

U.S. PATENT DOCUMENTS

| | | | |
|---|---|---|---|
| 4,431,480 | 2/1984 | Markham et al. | 162/19 |
| 4,435,249 | 3/1984 | Markham et al. | 162/24 |
| 4,439,271 | 3/1984 | Samuelson | 162/19 |
| 4,444,621 | 4/1984 | Lindhal | 162/26 |
| 4,450,044 | 5/1984 | Fritzvold et al. | 162/65 |
| 4,451,332 | 5/1984 | Annergren et al. | 162/30.1 |
| 4,459,174 | 7/1984 | Papageorges et al. | 162/40 |
| 4,468,286 | 8/1984 | Johnsen | 162/17 |
| 4,563,243 | 1/1986 | Koch et al. | 162/18 |
| 4,568,420 | 2/1986 | Nommi | 162/65 |
| 4,595,455 | 6/1986 | Mannbro | 162/38 |
| 4,640,782 | 2/1987 | Burleson | 210/748 |
| 4,806,203 | 2/1989 | Elton | 162/65 |
| 4,840,703 | 6/1989 | Malmsten | 162/49 |
| 5,085,734 | 2/1992 | Griggs | 162/65 |
| 5,164,043 | 11/1992 | Griggs et al. | 162/65 |
| 5,174,861 | 12/1992 | White et al. | 162/65 |

FOREIGN PATENT DOCUMENTS

| | | | |
|---|---|---|---|
| 0308314 | 3/1989 | European Pat. Off. . | |
| 2620744 | 3/1989 | France | 162/65 |
| WO88/03095 | 7/1988 | WIPO . | |
| WO91/18145 | 11/1991 | WIPO | 162/65 |

OTHER PUBLICATIONS and Control of Bleaching Stages", Nordic Pulp and Paper Research Journal, No. 1 (1987).

Katai and Schuerch, "Mechanism of Ozone Attack on Alpha-Methyl Glucoside and Cellulosic Materials".

Balousck, "The Effects of Ozone Upon Lignin Model Containing the P-aryl Ether Linkage", Svensk Papperstidning, No. 9, 1981.

DeSousa et al., "The Influence of Chlorine Ratio and Oxygen Bleaching on the Formation of PCDF's and PCCD's in Pulp Bleaching", Tappi Journal (Apr. 1989).

Tritschler and Shelton, "Commercial Manufacture and Industrial Use of Ozone and an Oxidant".

Voss et al., "Some New Insights Into the Origins of Dioxins Formed During Chemical Pulp Bleaching", Pulp and Paper Canada, 89:12 (1988).

Abrahanson and Samuelson, "Oxygen/Sodium Carbonate Bleaching of Kraft Pulp Pretreated with Nitrogen Dioxide and Oxygen", Svensk Papperstidning (1983).

Eickeler, "Ozone Measurement with Detector Tubes".

Ouederni, "Simulation of the Ozone/Lignin Reaction in an Agitated vessel".

Gierer, "Chemistry of Delignification, Part 2: Reactions of Lignins During Bleaching", Word Science and Technology (1986).

Fossum et al., "Final Bleaching of Kraft Pulps Delignified to Low Kappa Number by Oxygen Bleaching", Tappi Journal pp. 60–62 (Dec. 1983).

Liebergott, et al., Bleaching a Softwood Kraft Pulp Without Chlorine Compounds, TAPPI Journal, p. 76 (Aug. 1984).

Liebergott, et al., Bleaching a Softwood Kraft Pulp Without Chlorine Compounds, pp. 1–10.

Allison, Production of Bleached Softwood Pulp by Low Pollution Processes, Wood Sci. Technol. 17, pp. 129–137 (1983).

Patt, et al., Use of Ozone For Pulp Bleaching, Papier, 42 (10A), V 14–23 (1988).

Soteland, Comparison Between Oxygen and Ozone Delignification of Sulphite Pulps, TAPPI Symposium—Oxygen Delignification p. 71 (1984).

Gupta, et al., OZ Prebleaching, Influence on Viscosity and Sheet Strength, TAPPI Symposium—Oxygen Delignification, p. 1 (1984).

Heimburger et al., Kraft Mill Bleach Plant Effluents: Recent Developments Aimed at Decreasing Their Environmental Impact.

Heimburger et al., Kraft Mill Bleach Plant Effluents: Recent Developments Aimed at Decreasing Thier Environmental Impact Part II, TAPPI Journal, p. 69 (Nov. 1988).

Sarkanen, et al., Chlorination-free Doxy Bleaching Process for Kraft Pulps.

Klein et al. Delignifying Bleaching of Sulfite Pulps With Hydrogen Peroxide, EUCEPA Conference Report (Jun. 1980).

Perkins et al., Advances in Ozone Bleaching—Part III—Pilot Plant Installations and Proposed Commercial Implementation.

Singh, Advances in Ozone Bleaching—Part I: The Ozone Bleaching Process—Laboratory to Pilot Plant.

Singh, Ozone Replaces Chlorine in the First Bleaching Stage: Advances in Ozone Bleaching—Part I, TAPPI Journal, p. 45 (Feb. 1982).

Leibergott, et al., The Use of Ozone in Bleaching and Brightening Wood Pulps: Part I—Chemical Pulps (TAPPI 1978).

Ow, et al., Advances In Ozone Bleaching: Part II: Bleaching of Softwood Kraft Pulps With Oxygen and Ozone Combination, TAPPI Symposium—Oxygen Delignification (1984).

METHOD FOR CHELATION OF PULP PRIOR TO OZONE DELIGNIFICATION

This application is a continuation of application Ser. No. 07/896,481 filed Jun. 2, 1992, which is a continuation of application Ser. No. 07/525,808 filed May 2, 1990, abandoned.

FIELD OF THE INVENTION

This invention relates to a novel, environmentally acceptable process for delignifying and bleaching lignocellulosic pulp which does not require the use of elemental chlorine and which produces a pulp of acceptable strength. Use of this process also reduces the amount of environmental pollutants.

BACKGROUND OF THE INVENTION

Wood is comprised of two main components—a fibrous carbohydrate, i.e., cellulosic portion, and a non-fibrous component. The polymeric chains forming the fibrous cellulose portion of the wood are aligned with one another and form strong associated bonds with adjacent chains. The non-fibrous portion of the wood comprises a three-dimensional polymeric material formed primarily of phenylpropane units, known as lignin. Part of the lignin is between the cellulosic fibers, bonding them into a solid mass, although a substantial portion of the lignin is also distributed within the fibers themselves.

For use in paper-making processes, wood must first be reduced to pulp. Pulp may be defined as wood fibers capable of being slurried or suspended and then deposited upon a screen to form a sheet, i.e., of paper. The methods employed to accomplish the pulping step usually involve either physical or chemical treatment of the wood, or a combination of these two treatments, to alter the wood's chemical form and to impart desired properties to the resultant product. There are thus two main types of pulping techniques, i.e., mechanical pulping and chemical pulping. In mechanical pulping, the wood is physically separated into individual fibers. In chemical pulping, the wood chips are digested with chemical solutions to solubilize a portion of the lignin and thus permit its removal. The commonly utilized chemical pulping processes are broadly classified as: (1) the soda process, (2) the sulfite process, and (3) the Kraft process, with the latter process being most commonly used and being capable of a variety of well-known modifications as described below.

The soda process is well known in the art. It employs sodium hydroxide (NaOH) as the active reagent to break down the lignin and to assist in its removal. The sulfite process is also well known in the art (see, e.g., *Handbook for Pulp & Paper Technologists*—Chapter 6: Sulfite Pulping (TAPPI, U.S.A.).

The Kraft process together with its numerous variations is the principle chemical process utilized in paper manufacturing. The basic Kraft process, as described in the *Handbook For Pulp and Paper Technologists*—Chapter 7: Kraft Pulping (TAPPI, U.S.A.), involves digesting the wood chips in an aqueous solution of sodium hydroxide (NaOH) and sodium sulfide ($Na_2S$). This process is highly effective in the pulping of even difficult woods such as southern softwoods, as well as the other more readily pulped species of wood such as northern hardwoods and softwoods. The Kraft process likewise generally produces a relatively high-strength pulp since its use results in a diminished attack on the cellulose component of the wood.

The modified Kraft techniques can result in even less degradation in the polymeric structure of the cellulosic fibers during pulping and therefore the strength loss in the resultant paper product is diminished as compared to that occurring with the standard Kraft process. One modified Kraft pulping process is known as "extended delignification", which is a broad term used in the art to encompass a variety of modified Kraft techniques, such as adding the pulping chemicals in a specific defined sequence, or at different locations within the digester apparatus, or at different time periods, or with a removal and reinjection of cooling liquors in a prescribed sequence, so as to more effectively remove a greater amount of lignin while reducing the severity of the pulping liquor's chemical attack on the cellulosic fibers. Another modification of the Kraft process is the Kraft-AQ process, wherein a small amount of anthraquinone is added to the Kraft pulping liquor to accelerate delignification while limiting the attack upon the cellulosic fibers which comprise the wood.

A variety of additional extended delignification techniques are known in the art and include Kamyr Modified Continuous Cooking (MCC) as described by V. A. Kortelainen and E. A. Backlund in *TAPPI*, vol. 68 (11), 70 (1985); Beloit Rapid Displacement Heating (RDH) as reported by R. S. Grant in *TAPPI*, vol. 66 (3), 120 (1983); and Sunds Cold Blow Cooking as reported by B. Pettersson and B. Ernerfeldt in *Pulp and Paper*, vol. 59 (11), 90 (1985).

Digestion of the wood by a Kraft or modified Kraft process results in the formation of a dark colored slurry of cellulose fibers known as "brownstock". The dark color of the brownstock is attributable to the fact that not all of the lignin has been removed during digestion and has been chemically modified in pulping to form chromophoric groups. Thus, in order to lighten the color of the brownstock pulp, i.e., to make it suitable for use as printing and writing and other white paper applications, it is necessary to continue the removal of the remaining lignin by the addition of delignifying materials and by chemically converting any residual lignin into colorless compounds by a process known as "bleaching" or "brightening".

Prior to bleaching the pulp, however, the digested material is conventionally transferred to a separate blow tank after the chemical treatments involved in the pulping process are completed. Within the blow tank, the pressure developed during the initial chemical treatment of the lignocellulosic material is relieved and the pulp material is separated into a fibrous mass. The resulting fibrous mass is then subjected to a series of washing steps to remove the combination of any residual chemicals and the soluble materials (such as the lignin) which were separated from the fibrous materials in the pulping process. Frequently, the pulp also undergoes one or more screening steps designed to separate out the larger portions of undefibered wood for special processing (recooking, mechanical grinding, etc.).

The residue obtained from the washing process, commonly referred to as black liquor, is collected, concentrated, and then incinerated in an environmentally safe manner in a recovery boiler. The technique for the collection, concentration and burning of the black liquor is conventional and is well known in the art.

The delignification and bleaching processes are conducted on the washed fibrous mass in a series of steps, using selected combinations of chemical reactants. In the prior art, various combinations of chemical treatments have been suggested. Furthermore, individual treatment steps have been rearranged in an almost limitless number of combinations and permutations. Therefore, in order to simplify the explanation of the various bleaching processes and systems, the use of letter codes is conventionally employed in combination to describe the particular chemical reactants employed and the sequence of the steps of the process.

The letter codes which will be used hereafter, where appropriate, are as follows:

| | | |
|---|---|---|
| C = | Chlorination | Reaction with elemental chlorine in acidic medium. |
| E = | Alkaline Extraction | Dissolution of reaction products with NaOH. |
| $E_o$ = | Oxidative Alkaline Extraction | Dissolution of reaction products with NaOH and Oxygen. |
| D = | Chlorine Dioxide | Reaction with $ClO_2$ in acidic medium. |
| P = | Peroxide | Reaction with peroxides in alkaline medium. |
| O = | Oxygen | Reaction with elemental oxygen in alkaline medium. |
| $O_m$ = | Modified Oxygen | Uniform alkali treatment of low to medium consistency pulp followed by reaction of high consistency pulp with oxygen. |
| Z = | Ozone | Reaction with ozone. |
| $Z_m$ = | Modified Ozone | Uniform reaction with ozone. |
| C/D | | Admixtures of chlorine and chlorine dioxide. |
| H = | Hypochlorite | Reaction with hypochlorite in an alkaline solution. |

$O_m$ and $Z_m$ are modified processes according to the present invention and are described further in the Detailed Description of the Invention.

It has been conventional for many years to delignify and bleach wood pulp by using elemental chlorine. Exemplifying the bleaching of lignocellulosic pulps are the processes disclosed in, for example, U.S. Pat. No. 1,957,937 to Campbell et al., U.S. Pat. No. 2,975,169 to Cranford et al. and, U.S. Pat. No. 3,462,344 to Kindron et al.; and *Handbook For Pulp and Paper Technologists*—Chapter 11: Bleaching (§11.3) (TAPPI, U.S.A.).

However, although elemental chlorine has proven to be an effective bleaching agent, it is difficult to handle and potentially hazardous to both mill personnel and equipment. For example, the effluents from chlorine bleaching processes contain large amounts of chlorides produced as the by-product of these processes. These chlorides readily corrode processing equipment, thus requiring use of costly materials in the construction of such mills. Further, the build-up of chlorides within the mill precludes recycling the washer filtrate after a chlorination stage in a closed system operation without employing recovery systems requiring extensive, and therefore expensive, modifications. In addition, concern about the potential environmental effects of chlorinated organics in effluents, which the U.S. Environmental Protection Agency believes to be toxic to humans and animals, has caused significant changes in government requirements and permits for bleach mills which include standards that may be impossible to meet with conventional bleaching or pollution control technology.

To avoid these disadvantages, the paper industry has attempted to reduce or eliminate the use of elemental chlorine and chlorine-containing compounds from multi-stage bleaching processes for lignocellulosic pulps. Complicating these efforts is the requirement that high levels of pulp brightness are required for many of the applications for which such pulp is to be used.

In this connection, efforts have been made to develop a bleaching process in which chlorine-containing agents are replaced, for example, by oxygen for the purpose of bleaching the pulp. The use of oxygen does permit the recycling of effluent from this stage for recovery and does permit a substantial reduction in the amount of elemental chlorine used. A number of processes for bleaching and delignifying pulp with oxygen have been proposed, such as Richter U.S. Pat. No. 1,860,432, Grangaard et al. U.S. Pat. Nos. 2,926,114 and 3,024,158, Gaschke et al. U.S. Pat. No. 3,274,049, Meylan et al. U.S. Pat. No. 3,384,533, Watanabe U.S. Pat. No. 3,251,730, Rerolle et al. U.S. Pat. No. 3,423,282, Farley U.S. Pat. No. 3,661,699, Kooi U.S. Pat. No. 4,619,733 and P. Christensen in "Bleaching of Sulphate Pulps with Hydrogen Peroxide", *Norsk Skogindustri,* 268–271 (1973). Alkaline pretreatments of pulp prior to oxygen delignification are suggested by U.S. Pat. No. 4,806,203 to Elton.

The use of oxygen, however, is not a completely satisfactory solution to the problems encountered with elemental chlorine. Oxygen is not as selective a delignification agent as elemental chlorine, and the K No. of the pulp, using conventional oxygen delignification methods, can be reduced only a limited amount until there is a disproportionate, i.e., unacceptable, attack on the cellulosic fibers. Also, after oxygen delignification, the remaining lignin has heretofore typically been removed by chlorine bleaching methods to obtain a fully-bleached pulp, but using much reduced amounts of chlorine. However, even at such reduced chlorine concentrations, the corrosive chlorides would soon reach unacceptable concentration levels in a closed cycle operation.

To avoid the use of chlorine bleaching agents, the removal of such remaining lignin with the use of ozone in the bleaching of chemical pulp has previously been attempted. Although ozone may initially appear to be an ideal material for bleaching lignocellulosic materials, the exceptional oxidative properties of ozone and its relative high cost have heretofore limited the development of satisfactory ozone bleaching processes for lignocellulosic materials, especially southern softwoods. Ozone will readily react with lignin to effectively reduce the K No., but it will also, under most conditions, aggressively attack the carbohydrate which comprises the cellulosic fibers and substantially reduce the strength of the resulting pulp. Ozone, likewise, is extremely sensitive to process conditions such as pH with respect to its oxidative and chemical stability, and such changes can significantly alter the reactivity of ozone with respect to the lignocellulosic materials.

Since around the turn of the century, when the delignifying capabilities of ozone were first recognized, there has been substantial and continuous work by numerous persons in the field to develop a commercially suitable method using ozone in the bleaching of lignocellulosic materials. Furthermore, numerous articles and patents have been issued in this area and there have been reports of attempts at conducting ozone bleaching on a non-commercial pilot scale basis. For example, U.S. Pat. No. 2,466,633 to Brabender et al., describes a bleaching process wherein ozone is passed through a pulp having a moisture content (adjusted to an oven dry consistency) of between 25 and 55 per cent and a pH adjusted to the range of 4 to 7.

Other non-chlorine bleach sequences are described by S. Rothenberg, D. Robinson & D. Johnsonbaugh, "Bleaching of Oxygen Pulps with Ozone", *Tappi* 182–185 (1975)—Z, ZEZ, ZP and $ZP_a$ ($P_a$-peroxyacetic acid); and N. Soteland, "Bleaching of Chemical Pulps With Oxygen and Ozone", *Pulp and Paper Magazine of Canada;* T153–58 (1974)—OZEP, OP and ZP.

Also, U.S. Pat. No. 4,196,043 to Singh discloses a multi-stage bleaching process which also attempts to eliminate the use of chlorine compounds, and includes examples specifically directed to hardwoods. It is well known to those skilled in the art that hardwoods are easier to bleach than most softwoods. This process is characterized by from one to three ozone bleaching stages and a final treatment with alkaline hydrogen peroxide, each stage being separated by an alkaline extraction. One such sequence may be described in the common shorthand nomenclature of the paper industry as ZEZEP. In accordance with this process, the effluent from each treatment stage may be collected and recycled for use in bleaching operations, preferably at an earlier stage than that from which it was obtained. This patent also provides a so-called countercurrent effluent flow.

Despite all of the research conducted in this area, no commercially feasible process for the manufacture of ozone bleached lignocellulosic pulps, especially southern softwood, has heretofore been disclosed, and numerous failures have been reported.

The present invention provides novel combinations of pulping and bleaching steps which overcome the problems encountered in the prior art as discussed herein and which essentially eliminate the discharge of chlorinated organics and minimizes color and BOD releases to produce a high grade bleached pulp in a commercially feasible manner.

SUMMARY OF THE INVENTION

Accordingly, it is an object of the present invention to provide a multi-stage process for delignifying and bleaching lignocellulosic pulp without the use of elemental chlorine bleaching agents to substantially reduce or eliminate pollution of the environment while optimizing the physical properties of the pulp in an energy efficient, cost effective process. The present invention can work on virtually all wood species, including the difficult-to-bleach southern U.S. softwoods.

The process of the present invention is composed of three or more steps with a number of possible variations within and between the steps. These steps can be described as follows:

A first step involves delignification of wood chips into a lignocellulosic pulp, using any one of several chemical pulping processes, followed by a washing removal of most of the dissolved organics and cooking chemicals for recycle and recovery. Usually included is a screening of the pulp to remove bundles of fibers that have not been separated in pulping. This delignification step is conducted so that, for a southern U.S. softwood, for example, pulp with a K No. in the range of about 20–24 (target of 21), a cupriethylenediamine ("CED") viscosity in the range of about 21–28, and a GE brightness in the range of about 15–25 is typically obtained. For southern U.S. hardwood, pulp with a K No. in the range of about 10–14 (target 12.5) and a CED viscosity of about 21–28 is typically obtained.

Among, but not limited to, the effective embodiments of this first step are:

a. Kraft pulping using either a continuous or batch digestion stage;
b. Continuous digestion kraft pulping with extended delignification using staged alkali addition and countercurrent final cooking;
c. Batch digestion kraft pulping with extended delignification using rapid liquor displacement and cold blowing techniques; or
d. Kraft-AQ pulping to achieve extended delignification using either a continuous or batch digestion stage.

The extended delignification techniques discussed in (b) and (c) above, may include, for example, the Kamyr MCC, the Beloit RDH and Sunds Cold Blow Cooking techniques described in the background portion of this specification. Depending upon the type of lignocellulosic material used, the soda and sulfite processes mentioned above may be used.

A second step of the process includes an oxygen delignification treatment to further remove lignin without an accompanying significant loss in cellulosic fiber strength. This would include a washing removal of the dissolved organics and alkali for recycle and recovery. Pulp screening is also performed at times after oxygen delignification.

During the oxygen delignification step, the K No. of the increased consistency pulp is decreased by at least about 45% (for O) to at least about 60% (for $O_m$) without significantly damaging the cellulose component of the pulp. Also, the ratio of K No. to viscosity of the pulp is typically decreased by at least 25%. For the softwood pulp described above using $O_m$, a K No. of about 7 to 10 and a viscosity of above about 13 is easily achieved. For hardwood pulp, a K No. of about 5 to 8 and a viscosity above about 13 is achieved after the oxygen delignification step.

Among, but not limited to, the possible embodiments to this step are:

a. Conventional oxygen delignification, comprised of an alkaline oxygen treatment of the pulp at either low, medium, or high pulp consistency (O); or
b. The preferred embodiment of an alkaline treatment at low to medium pulp consistency, i.e., less than about 10% by weight, followed by high pulp consistency oxygen treatment, i.e,. greater than about 20% by weight ($O_m$).

For pulp end uses that do not require brightnesses above about 35% GEB (often referred to as semi-bleached pulp), it is possible to use pulp that has been processed only through step 2 directly in the papermaking process.

A third step of the process includes an acidic, gaseous ozone bleaching treatment (Z or $Z_m$) under defined process parameters to provide a highly selective removal and bleaching of lignin with minimal degradation of cellulose. Among the process parameters are chelating agents for metal ion control, pH control, pulp particle size control, pulp consistency, ozone concentration and gas/pulp contact control. Prior to treatment with ozone, the chelating agent, for example oxalic acid, diethylenetriamine pentaacetic acid ("DTPA") or ethylene diaminetetraacetic acid ("EDTA") may be added to the pulp to substantially bind with metal ions contained therein. Further, the pH of the pulp is preferably adjusted to a range of between about 1–4 prior to the third step. This may be accomplished by adding to the pulp a sufficient quantity of an acidic material. Advantageously, the consistency of the pulp is increased to between about 35–45% by weight and the particle size of the fiber flocs are comminuted to a size of about 5 mm or less prior to the ozone delignification step. Included is a dissolved organic washing stage for recycle and recovery.

During the ozone step, the pulp is preferably maintained at ambient temperature or at least at a pulp temperature of less than about 120° F. The ozone may be provided by an ozone-containing gas which may comprise, for example, oxygen or air. When an ozone/oxygen mixture is used, the ozone concentration is preferably between about 1 and 8 percent by volume, whereas for ozone/air mixtures, an ozone concentration of between about 1 and 4 percent by volume is acceptable. Within the ozone reactor vessel, the substantially delignified pulp is advanced in a manner which subjects substantially all of the pulp particles to the ozone in a uniform fashion.

It has been found that pulps with K Nos. greater than about 10 after the second step are not suitable for this third step, because of the substantial amounts of ozone required to reduce the K No. to the desired level, which typically results in the properties of the pulp being adversely and deleteriously affected by excessive ozone degradation of the cellulose fibers of the pulp. When pulp having a K No. of less than 10 is ozonated, a lesser concentration of ozone is used, with only a minimal amount of cellulose degradation occurring. The product from this ozonation step for either the starting southern U.S. softwood or hardwood described above is a pulp having a K No. of less than about 5 and generally in the range of about 3 to 4 (target of 3.5), a viscosity of above about 10, and a GE brightness of at least 50% (typically about 54% or higher for softwood and 63% or higher for hardwood).

Among, but not limited to, the effective embodiments for this step are:

a. Treatment of the acidified pulp by countercurrent contact of ozone in an oxygen or air carrier gas; or
b. Treatment of the acidified pulp by cocurrent contact of ozone in an oxygen or air carrier gas.

An additional bleaching step may then be used to bring the pulp to a desired fully bleached state, i.e., one having GE brightness levels of about 70 to 95% using any number of possible, well recognized bleaching and extraction processes. Among, but not limited to, the effective embodiments are:

a. A conventional extraction stage with washing followed by a peroxide stage with washing; (i.e., EP);
b. Conventional alkali extraction and washing stages followed by a conventional chlorine dioxide stage with washing (i.e., ED);
c. A conventional alkali extraction and washing stage followed by a conventional chlorine dioxide stage with washing, followed by a repeat of the extraction and chlorine dioxide stages (i.e., EDED); or
d. An extraction stage, augmented with either oxygen or oxygen and peroxide, followed by a conventional chlorine dioxide stage: i.e., $(E_o)D$ or $(E_{op})D$.

The extraction stage may comprise, in a further embodiment, combining the substantially delignified pulp with an effective amount of an alkaline material in an aqueous alkaline solution for a predetermined time and at a predetermined temperature correlated to the quantity of alkaline material to solubilize a substantial portion of any lignin which remains in the pulp. Thereafter, a portion of the aqueous alkaline solution may be extracted to remove substantially all of the solubilized lignin therefrom.

Following the extraction stage, the substantially delignified pulp may be treated in the additional bleaching step to raise the GE brightness of the resultant pulp to at least about 70%. Preferred brightening agents include chlorine dioxide or a peroxide.

The $(E_o)D$, $(E_{op})D$ or EDED embodiments will achieve the highest brightness levels. For the ED embodiment, the chlorine dioxide stage filtrate cannot, without treatment, be recycled for chemical recovery because of the presence of the inorganic chlorides. Since this is the only required sewered filtrate from the process, however, dramatic reductions in effluent volume, color, COD, BOD, and chlorinated organics are achieved. Color of less than 2 pounds per ton, $BOD_5$ of less than 2 pounds per ton and total organic chloride (TOCl) of less than 2 and preferably less than 0.8 can be achieved. It is also possible to treat the chlorine dioxide stage filtrate with a membrane filtration process which will allow essentially complete recycle. In the EP embodiment, no chlorinated materials are formed in the bleaching process and virtually all the liquid filtrates can be recycled and recovered, producing an almost effluent-free process.

DETAILED DESCRIPTION OF THE INVENTION

Figure 1:
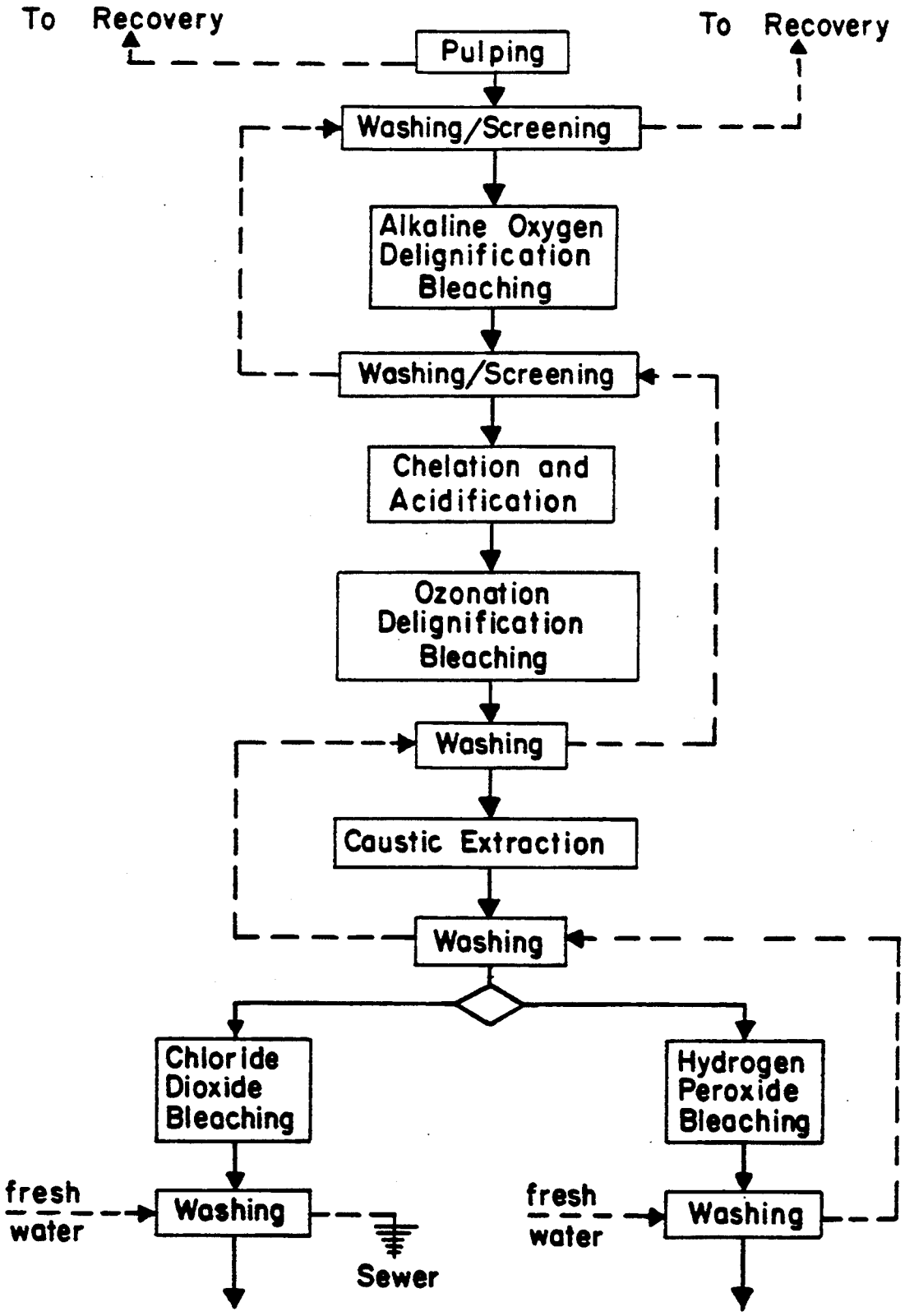
FIG. 1 is a block flow diagram of the preferred methods of this invention wherein a solid line represents pulp flow and a broken line represents effluent flow.

The present invention relates to novel methods for delignifying and bleaching pulp while minimizing the degree of attack upon the cellulosic portion of the wood, thus forming a product having acceptable strength properties for the manufacture of paper and various paper products. For convenience in understanding the improvement over the prior art offered with the use of the presently disclosed delignification and bleaching process, provided below are the definitions of several parameters involved in the various stages in any delignification/bleaching process.

A. General Definitions

Throughout this specification, the following definitions will be used:

"Consistency" is defined as the amount of pulp fiber in a slurry, expressed as a percentage of the total weight of the oven dry fiber and water. It is sometimes also referred to as pulp concentration. The consistency of a pulp will depend upon operation of and the type of dewatering equipment used. The following definitions are based on those found in Rydholm, *Pulping Processes,*

Interscience Publishers, 1965, pages 862–863 and TAPPI Monograph No. 27, *The Bleaching of Pulp*, Rapson, Ed., The Technical Association of Pulp and Paper Industry, 1963, pages 186–187.

"Low consistency" includes ranges up to 6%, usually between 3 and 5%. It is a suspension that is pumpable by an ordinary centrifugal pump and is obtainable using deckers and filters without press rolls.

"Medium consistency" is between about 6 and 20%. Fifteen percent is a dividing point within the medium-consistency range. Below 15% the consistency can be obtained by filters. This is the consistency of the pulp mat leaving a vacuum drum filter in the brownstock washing system and the bleaching system. The consistency of a slurry from a washer, either a brownstock washer or a bleaching stage washer, is 9–15%. Above about 15%, press rolls are needed for dewatering. Rydholm states that the usual range for medium consistency is 10–18%, while Rapson states it is 9–15%. The slurry is pumpable by special machinery even though it is still a coherent liquid phase at higher temperatures and under some compression.

"High consistency" is above about 20% up to about 50%. Rydholm states that the usual range is 25–35% and Rapson states that the range is from 20–35%. These consistencies are obtainable only by the use of presses. The liquid phase is completely absorbed by the fibers, and the pulp can be pumped only very short distances.

Further, in this specification "pulping" is used in its conventional sense to refer to a digestion of lignocellulosic material to form brownstock. Pulping would include, for example, Kraft, the Kraft-AQ process and forms of extended delignification.

The term "modified Kraft process" is used herein to include extended delignification and all other modified Kraft processes with the exception of the Kraft-AQ process, since this process has achieved a special status and acceptance in the art and is separately known by that name. Also, the oxygen delignification step following completion of pulping will not be considered as an extended delignification; rather, we have chosen to call it a first step of a delignification process for bleaching or brightening the pulp.

Further, there are two principal types of measurements to determine the completeness of the pulping or bleaching process, i.e., the "degree of delignification" and the "brightness" of the pulp. The degree of delignification is normally used in connection with the pulping process and the early bleaching stages. It tends to be less precise when only small amounts of lignin are present in the pulp, i.e., in the later bleaching stages. The brightness factor is normally used in connection with the bleaching process because it tends to be more precise when the pulp is lightly colored and its reflectivity is high.

There are many methods of measuring the degree of delignification but most are variations of the permanganate test. The normal permanganate test provides a permanganate or "K No." which is the number of cubic centimeters of tenth normal potassium permanganate solution consumed by one gram of oven dried pulp under specified conditions. It is determined by TAPPI Standard Test T-214.

There are also a number of methods of measuring pulp brightness. This parameter is usually a measure of reflectivity and its value is expressed as a percent of some scale. A standard method is GE brightness which is expressed as a percentage of a maximum GE brightness as determined by TAPPI Standard Method TPD-103.

Moreover, where appropriate, the letter codes described in the Background Art section will be utilized to designate the various stages of pulp treatment throughout this Detailed Description of the Invention.

B. The Process Steps of the Invention

The values (i.e., K No., viscosity and GE brightness) obtained by use of the present pulping, delignification and bleaching process, as set forth below, demonstrate the ability of this process to enhance the degree of lignin removal from the pulp while minimizing the resultant degradation of the cellulose. After the oxygen delignification step, and prior to brightening, the pulp has been partially delignified to a K No. of about 5 to 10, preferably between about 7 to 10 for U.S. softwoods and about 5 to 7 for U.S. hardwoods. This partially delignified pulp has a viscosity of above about 10, generally more than 13 and preferably, at least 14 (for softwood pulp) or 15 (for hardwood pulp). This partially delignified material thus has good strength and suitable viscosity so that it can withstand the effects of ozone. The partially delignified pulp is subjected to ozone to further delignify the pulp, thus reducing the K No. of the pulp to about 3 to 4 for both softwoods and hardwoods while increasing the GE brightness of the pulp to at least about 50–70%. For softwood pulp, a GE brightness of about 54% or higher is typically achieved, while for hardwood pulp, values of about 63% or more are attained. Thereafter, the brightness of the pulp is further increased by an alkali extraction and an additional bleaching step using chlorine dioxide or peroxide.

For convenience in understanding the present invention therefore, FIG. 1 sets forth, in schematic form, the various stages utilized in pulping, delignifying and brightening a pulp according to the invention. As illustrated in FIG. 1, the invention comprises a multi-stage process including the steps of:

(a) pulping the lignocellulosic material whereby the pulping chemicals may be recovered and reused in a manner well-known in the art;

(b) washing the pulp to remove chemical residues from the pulping liquor together with residual lignin and usually including a screening of the pulp to remove fiber bundles that have not been separated during pulping;

(c) alkaline oxygen delignification (i.e., O or $O_m$) of the pulp;

(d) washing the partially delignified pulp obtained in step (c) above to remove dissolved organics from the oxygen treatment; optionally, screening may be done at this point, while also recycling at least a portion of the effluent from this step to a previous step;

(e) chelation and acidification of the pulp to bind metal ions and to adjust the pH to a preferred level;

(f) contacting the pulp with ozone (i.e., Z or $Z_m$) to further delignify and to partially bleach this material;

(g) washing the ozonated pulp, while recycling at least a portion of the effluent from this step to a previous step;

(h) caustic extraction to remove residual lignin;

(i) washing the extracted pulp while recycling at least a portion of the effluent to a previous step;

(j) adding a second bleaching agent (i.e., D or P to brighten and bleach the pulp);

(k) washing the bleached pulp to obtain a bleached product having a GE brightness of about 70–90%; and (l) recycling at least a portion of the effluent from the P bleaching stage to a previous step; or sewering the effluent from the D bleaching stage or, after appropriate treatment, recycling this effluent to a previous step.

1. Pulping

The first stage in the method of the present invention wherein procedures can be utilized which improve the amount of lignin removed from the lignocellulosic material while minimizing the amount of degradation of the cellulose, is in the pulping step. The particular pulping process used in the method of the invention is, to a large extent, dependent on the type of lignocellulosic materials and, more particularly, the type of wood which is used as a starting material. Moreover, as illustrated in FIG. 1, the pulping liquor used in chemical pulping techniques may be recovered and reused in a manner well-known in the art. This step is typically followed by washing to remove most of the dissolved organics and cooking chemicals for recycle and recovery, as well as a screening stage in which the pulp is passed through a screening apparatus to remove bundles of fibers that have not been separated in pulping.

The Kraft process is generally acceptable for use with all woods as compared to the other noted processes, as the final pulps obtained from the Kraft process have acceptable physical properties, although the brownstock pulp is also darker in color.

Depending upon the lignocellulosic starting material, the results obtained with conventional Kraft processes may be enhanced by the use of extended delignification techniques or the Kraft-AQ process. Moreover, these techniques are preferred for obtaining the greatest degree of reduction in K No. of the pulp without deleteriously affecting the strength and viscosity properties of the pulp.

When using the Kraft-AQ technique, the amount of anthraquinone in the cooking liquor should be an amount of at least about 0.01% by weight, based on the oven dried weight of the wood to be pulped, with amounts of from about 0.02 to about 0.1% generally being preferred. The inclusion of anthraquinone in the Kraft pulping process contributes significantly to the removal of the lignin without adversely affecting the desired strength characteristics of the remaining cellulose. Also, the additional cost for the anthraquinone is partially offset by the savings in cost of chemicals in the subsequent $Z_m$, E and D or P steps.

Alternatively, or perhaps even additively to Kraft-AQ, is the use of techniques for extended delignification such as the Kamyr MCC, Beloit RDH and Sunds Cold Blow Methods for batch digesters. These techniques also offer the ability to remove more of the lignin during pulping without adversely affecting the desired strength characteristics of the remaining cellulose.

2. Oxygen Delignification

The next step in the method of the present invention concerns the portion of the bleaching process which primarily involves removal of the residual lignin from the brownstock pulp being processed. In the method of this invention, this stage comprises an oxygen delignification step. The solid materials removed in this stage are oxygenated materials which can, like the black liquor, be collected, concentrated, and then incinerated in an environmentally safe manner in a conventional recovery boiler. At least a portion of the liquid phase is recycled as illustrated in FIG. 1.

It has been found that the oxygen delignification step can be conducted in the manner which allows for the removal of increased percentages of the remaining lignin in the brownstock pulp without causing an unacceptable corresponding decrease in the viscosity of the pulp. Broadly, the process which has been identified is practiced by treating the brownstock pulp from the pulping process at low to medium consistency, as described below, with the required amount of alkali necessary for the oxygen delignification step so as to ensure uniform application of the alkali, and thereafter raising the consistency and delignifying at high consistencies. Although high consistency delignification is preferred, low or medium consistency oxygen delignification techniques may be utilized in place of high consistency delignification.

The high consistency oxygen delignification step is preferably carried out in the presence of an aqueous alkaline solution at a pulp consistency of from about 25% to about 35%, and even more preferably, at about 27%. This improved process ($O_m$) allows for the removal of at least 60% of the residual lignin from the brownstock pulp, compared to the 45–50% removable with conventional oxygen delignification steps, without the heretofore expected undesirable decrease in the relative viscosity. Because of the unique process capabilities of this modified process, it clearly constitutes the preferred oxygen process for use in the method of this invention.

The treatment step of the modified oxygen process ($O_m$) comprises substantially uniformly combining wood pulp, preferably Kraft brownstock pulp, with an aqueous alkaline solution while maintaining the consistency of the pulp at less than about 10% and preferably less than about 5% by weight. The aqueous alkaline solution is preferably present in an amount sufficient to provide from about 0.5% to about 4% active alkali by weight after thickening based upon the oven dry pulp weight of the brownstock pulp, and even more preferably about 2.5% active alkali by weight after thickening based upon the oven dry weight of the brownstock pulp.

This step uniformly distributes the aqueous alkaline solution throughout the low consistency brownstock and ensures that substantially all the brownstock fibers are exposed to a uniform application of alkaline solution. Surprisingly, the brownstock pulp treated in this manner is not substantially delignified in the treatment step, but it is more effectively delignified in the subsequent high consistency oxygen delignification step than brownstock that is treated with alkaline solutions at high consistency according to the methods conventionally employed. The localized inhomogeneities in the distribution of alkali in conventional high consistency pulp are avoided, thus eliminating attendant non-uniform oxygen delignification.

This homogeneous distribution step thus preferably comprises uniformly combining the pulp with an aqueous alkaline solution for at least about i minute and preferably no more than about 15 minutes. It is believed that treatment times of less than about 1 minute will not generally provide sufficient time to attain substantially uniform distribution, whereas treatment times in excess of about 15 minutes are not expected to produce substantial further benefit.

Moreover, the preferred alkaline treatment of pulp according to the present invention may be carried out over a wide range of temperature conditions. According to a preferred practice, the treatment step is carried out at a temperature of from about room temperature to about 150° F., with temperatures ranging from about 90° F. to about 150° F. being even more preferred. Atmospheric pressure or elevated pressure may be employed. The treatment step is completed when the aqueous alkaline solution is substantially uniformly distributed throughout the low consistency pulp. The amount of aqueous alkaline solution present in the treatment step can vary greatly according to the particular process parameters of the delignification reaction. The amount of the alkaline solution effective for the purpose of the present invention will depend primarily upon the extent of delignification desired in the oxygen bleaching step and the strength of the particular solution being used. The aqueous alkaline solutions preferably used comprise a sodium hydroxide solution having a concentration of from about 20 to about 120 g/l. This solution is mixed with the low consistency pulp, so that the overall mixture has a concentration of alkaline material of between about 6.5 and 13.5 g/l, and preferably around 9 g/l. Thus, for a 5 to 15 minute treatment of a 3 to 5 percent consistency pulp at temperatures between 120° to 150° F. at these concentrations of alkaline material, a uniform distribution of such alkaline material is obtained throughout the pulp.

According to a preferred embodiment of the present invention, an aqueous sodium hydroxide solution is added to the low consistency pulp in an amount sufficient to provide from about 15% to about 30% by weight of sodium hydroxide based on dry pulp weight. Other alkaline sources having an equivalent sodium hydroxide content, such as oxidized white liquor from the conventional Kraft recovery and regeneration cycle, may also be employed.

Following the low consistency caustic treatment step described above, the consistency of the treated pulp is increased to greater than about 20%, preferably from about 25% to about 35%. Several methods are available and well known in the art for increasing the consistency of the pulp, such as pressing the wood pulp to remove liquid therefrom.

Thereafter, oxygen delignification is conducted on the high consistency pulp. Methods are available and well known in the art for dissolving gaseous oxygen into the liquid phase of high consistency pulp to affect delignification thereof. It is contemplated that any of these well known methods are adaptable for use according to the present invention. It is preferred, however, that oxygen delignification according to the present invention comprise introducing gaseous oxygen at about 80 to about 100 psig into the liquid phase of the high consistency pulp while maintaining the temperature of the pulp between about 90° C. and 130° C. The average contact time between the high consistency pulp and the gaseous oxygen is preferably from about 20 minutes to about 60 minutes.

By following the preferred process according to the present invention, it is possible to obtain a reduction in K No. for the pulp after the oxygen delignification step of at least about 60% with essentially no damage to the cellulose portion of the pulp. By comparison, conventional oxygen delignification can only achieve reductions in K No. of about 50% before degradation of cellulose occurs. Thus, the present preferred process unexpectedly provides an increase of at least 20% in delignification compared to prior art delignification processes: i.e., from 50% to at least about 60% reduction of the K No. for the incoming pulp. Reductions of 70% and more can even be achieved with minimal cellulose degradation. The avoidance of deterioration of the cellulose component of the pulp is evident by the minimal change in viscosity of pulp which is treated in accordance with the present invention.

Upon entering the oxygen delignification step, pulp K Nos. for the particular pulp range from about 10–26 depending upon the type of wood (e.g., for Kraft pulping, about 10–14, target 12.5 for hardwood and about 20–24, target 21, for softwood), while after oxygen delignification, the K No. is generally in the range of about 5–10.

Figure 2:
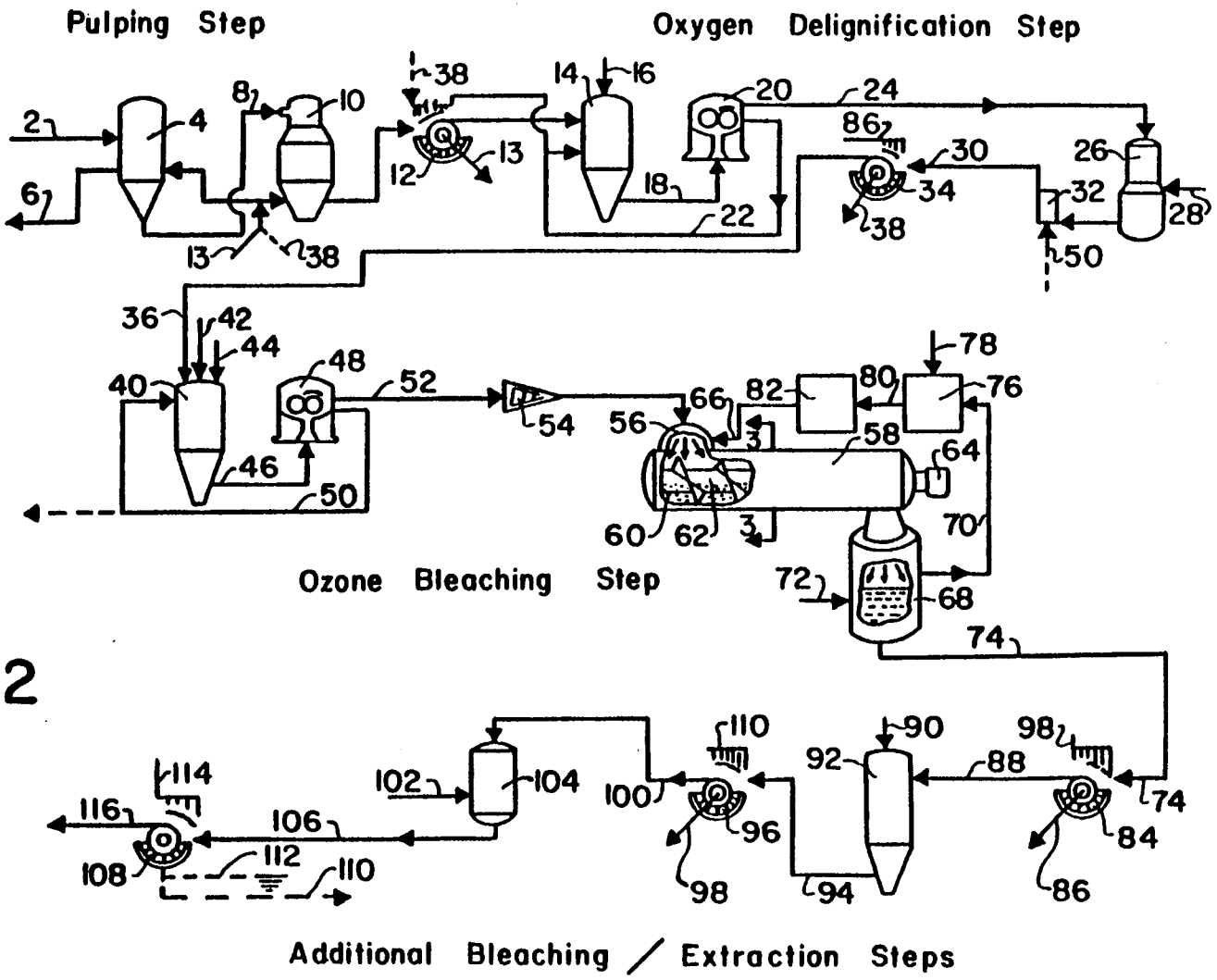
FIG. 2 is a schematic representation of a preferred method of the invention.

A processing scheme for carrying out the method of the present invention is depicted in schematic form in FIG. 2. The steps depicted therein represent a preferred operating system that tends to maximize certain benefits of the present invention. Wood chips 2 are introduced into a digester 4 where they are cooked in a liquor such as a liquor of sodium hydroxide and sodium sulfide. The cooking unit 4 produces a Kraft brownstock 8 and a black liquor 6 containing the reaction products of lignin solubilization. The brownstock is treated in washing units comprising, preferably, blow tank 10 and washer 12 where residual liquor contained in the pulp is removed. Many methods are available and well known in the art for washing brownstock, such as diffusion washing, rotary pressure washing, horizontal belt filtering, and dilution/extraction. These methods are all within the scope of the present invention. Also, screening of brownstock is often done either before or after the washing steps in order to remove larger portions of undefibered wood for special processing.

The washed brownstock is introduced into a treatment unit 14 where it is treated with an alkaline solution and maintained at a consistency of less than about 10% and preferably less than about 5%. The process of the present invention preferably includes means for introducing make-up caustic 16 into the treatment stage to maintain the desired caustic application level. The treated pulp 18 is forwarded to a thickening unit 20 where the consistency of the pulp is increased, by pressing for example, to at least about 20% by weight and preferably to about 25% to about 35%. The liquid 22 removed from the thickening unit 20 is preferably returned to washing unit 12 for further use. The high consistency "pressed" brownstock 24 produced in the thickening unit 20 is forwarded to the oxygen delignification reactor vessel 26 where it is contacted with gaseous oxygen 28. The delignified brownstock 30 is preferably forwarded through blow tank 32 and then to a second washing unit 34 wherein the pulp is washed with water to remove any dissolved organics and to produce high quality, low color pulp 36. At least a portion of the effluent 38 from this washing step is preferably returned to washing unit 12 for use therein. The effluent 13 from washing unit 12 may be recycled alone or optionally with all or a portion of effluent 38, to either the blow tank 10 or ultimately black liquor line 6. Additionally, the partially delignified pulp obtained after oxygen delignification may be screened to remove fiber bundles from the pulp that have not separated for further treatment such as mechanical grinding. From here, pulp 36 could be sent to subsequent bleaching stages to produce a fully bleached product.

In a particularly preferred method of the present invention as shown in FIG. 2, in order to successfully utilize ozone bleaching, Kraft pulping of the wood may be carried out, followed by the modified low-consistency alkali treatment/high consistency oxygen delignification procedure ($O_m$) described above. For softwoods, as noted above, this combination results in a pulp with a K No. of about 8 to 10, preferably 9, and a viscosity of greater than about 13 to 14. Alternatively, it is possible to subject the wood to Kraft AQ pulping followed by a conventional oxygen delignification step (i.e., 0, high consistency alkaline treatment followed by high consistency oxygen delignification) to achieve a pulp having similar characteristics. In place of Kraft AQ pulping, it is also possible to use extended delignification processes, followed by a standard oxygen delignification step to achieve pulp with the desired properties. Also useful, although less preferred due to increased costs or process steps, is the combination of Kraft pulping with extended delignification techniques such as Kamyr MCC, Beloit RDH or the Sunds Cold Blow Cooking process, as described in the Background Art section of this specification, followed by conventional oxygen delignification.

Any of a wide variety of pulping and oxygen delignification steps can be used in combination as long as they achieve the above K No. and viscosity values prior to the ozone step.

Conventional Kraft pulping followed by conventional oxygen delignification is generally not acceptable in this invention, except for certain hardwoods such as aspen which are relatively easy to delignify and bleach, since for a given wood species the combination of these conventional techniques normally requires the use of the greatest amount of ozone in the ozonation step with concomitant greater cellulose degradation.

By use of the present invention, the ozone consumption may be reduced by using a number of alternate routes, such as standard kraft cooking followed by a modified oxygen delignification step ($O_m$), or modified kraft pulping with extended delignification (such as Kamyr MCC, Baloit RDH or Sunds Cold Blow) followed by a conventional oxygen delignification step (O), or by Kraft AQ cooking followed by a conventional oxygen delignification step (O) as discussed above. An even greater reduction in ozone consumption will be achieved both with the use of modified Kraft pulping with extended delignification (Kamyr MCC, Beloit RDH or Sunds Cold Blow) followed by a modified oxygen delignification step ($O_m$), or alternately when a Kraft AQ cooking process with extended delignification (Kamyr MCC, Beloit RDH or Sunds Cold Blow) is followed by a conventional oxygen delignification step (O). Using all of these techniques together in one process, i.e., Kraft AQ cooking modified by extended delignification (Kamyr MCC, Beloit RDH or Sunds Cold Blow), followed by a modified oxygen delignification step ($O_m$), reduces the amount of ozone consumed even further. Reduction in the amount of ozone consumed generally permits the viscosity of the pulp to be maintained at acceptable levels.

The advantages of using the modified high consistency oxygen delignification bleaching step ($O_m$) described above are clearly illustrated by comparison of the K Nos. and viscosities obtained using southern softwoods to related processes under otherwise substantially identical process conditions. Using a conventional Kraft pulping procedure and conventional high consistency oxygen delignification bleaching, the resulting pulps obtained will typically have a K No. of about 12 to 14 and a viscosity of about 15. This K No. is too large to permit later delignification using the ozone stage of the present invention. However, the use of conventional Kraft pulping with the modified high consistency oxygen bleaching surprisingly results in a pulp having a K No. of less than about 9, while the viscosity of the pulp is above about 12 to 14. This preferred pulp K No. permits utilization of the ozone delignification bleaching stage of the invention.

3. The Ozone Step

The next step in the method of this invention is ozone delignification and bleaching of the oxygen-delignified brownstock pulp. This ozonation takes place in an ozone reactor which is described below in detail and illustrated in FIGS. 2, 3 and 3A. Prior to treatment of the pulp with the ozone, the pulp is conditioned so as to ensure the most effective selective delignification of the pulp and to minimize the chemical attack of the ozone on the cellulose. The incoming pulp 36 is directed into a mixing chest 40, where it is diluted to a low consistency. An acid 42 such as sulfuric acid, formic acid, acetic acid or the like, is added to the low consistency pulp to decrease the pH of the pulp in mixing chest 40 to the range of about 1 to 4 and preferably between 2 and 3. The pH is adjusted as described above since it is known that the relative effectiveness of ozone bleaching of pulps is dependent upon the pH of the pulp mixture. Lower pH values do not appear to have any beneficial effect on the further processing of the pulp, whereas increasing the pH to above about 4 to 5 causes a decrease in viscosity and an increase in ozone consumption.

The acidified pulp is treated with chelating agent 44 to complex any metals or metal salts which may be present in the pulp. This chelating step is used to render such metals non-reactive or harmless in the ozone reactor so that they will not cause breakdown of the ozone, thus decreasing the efficiency of the lignin removal and also reducing the viscosity of the cellulose.

Chelating agents are known per se and include, for example, polycarboxylate and polycarboxylate derivatives such as the di-, tri-, and tetra-carboxylates, amides, and the like. Preferred chelating agents for this ozone treatment, for reasons of cost and efficiency, include DTPA, EDTA and oxalic acid. Amounts of these chelating agents ranging from about 0.1% to about 0.2% by weight of oven dry pulp are generally effective, although additional amounts may be needed when high metal ion concentrations are present.

The effectiveness of the ozone bleaching process is controlled by a number of inter-related process parameters, including the pH level and the amount of metal salts in the pulp as discussed above. Another very important parameter is the consistency of the pulp during the ozone bleaching process. The pulp which is to be bleached must contain sufficient water so that the water exists as a continuous phase through the individual fibers, that is, the fiber should be sufficiently saturated with water. The water in the fiber allows the transfer of the ozone from the gaseous ozone atmosphere to both treat the outer surface of the fibers, and possibly more importantly, for the ozone to be transferred via the water phase to the less accessible interior portion of the individual fibers and thereby provide more complete removal of lignin from the fibers. The consistency, on the other hand, should not be so low that the ozone is diluted and tends to chemically break down rather than bleach the pulp.

The preferred range of consistency, especially for southern U.S. softwood, has been found to be between about 28% and about 50%, with the optimum results being obtained at between about 38% and about 45%. Within the above ranges, preferred results are obtained as indicated by the relative amount of delignification, the relatively low amount of degradation of the cellulose, and the noticeable increase in the brightness of the treated pulps.

The reaction temperature at which the ozone bleaching is conducted is likewise an important controlling factor in the process of the present invention. The ozone step can be effectively conducted at temperatures up to a certain critical temperature, at which the reaction commences to cause excessive degradation of the cellulose. This critical temperature will vary significantly depending upon the particular type of wood employed to form the pulp and the history of the prior treatment of the pulp. The maximum temperature of the pulp fiber at which the reaction should be conducted should not exceed the temperature at which excessive degradation of the cellulose occurs, which with southern U.S. softwood is a maximum of about 120° F.–150° F.

The ozone gas which is used in the bleaching process may be employed as a mixture of ozone with oxygen and/or an inert gas, or can be employed as a mixture of ozone with air. The amount of ozone which can satisfactorily be incorporated into the treatment gases is limited by the stability of the ozone in the gas mixture. Ozone gas mixtures which typically contain about 1–8% by weight of ozone in an ozone/oxygen mixture, or about 1–4% ozone in an ozone/air mixture, are suitable for use in this invention. The higher concentration of ozone in the ozone gas mixture allows for the use of relatively smaller size reactors and shorter reaction time to treat equivalent amounts of pulp, thereby lessening the capital cost required for the equipment. However, ozone gas mixtures containing lower amounts of ozone tend to be less expensive to produce and may reduce operating costs.

A further controlling factor is the relative weight of the ozone used to bleach a given weight of the pulp. This amount is determined, at least in part, by the amount of lignin which is to be removed during the ozone bleaching process, balanced against the relative amount of degradation of the cellulose which can be tolerated during ozone bleaching. In accordance with the preferred method of this invention, an amount of ozone is used which will react with about 50% to 70% of the lignin present in the pulp. The entire amount of lignin in the pulp is not removed in the ozone bleaching step as evidenced by the K No. of about 3 to 4 obtained after this step, because the absence of all lignin in the reaction zone would result in the ozone reacting excessively with the cellulose to substantially decrease the degree of polymerization of the cellulose. In the preferred method of this invention, the amount of ozone added, based on the oven dried weight of the pulp, typically is about from 0.2% to about 1% to reach the lignin levels of a 3–4 K No. Higher amounts may be required if significant quantities of dissolved solids are present in the system.

The time of the reaction used for the ozone bleaching step is determined by the desired rate of completion of the ozone bleaching reaction as indicated by complete or substantially complete consumption of the ozone which is utilized. This time will vary depending upon the concentration of the ozone in the ozone gas mixture, with relatively more concentrated ozone mixtures reacting more quickly, and the relative amount of lignin which it is desired to remove. The time required is preferably less than two minutes, but the procedure may take substantially longer depending on other reaction parameters.

An important feature of the invention is that the pulp is bleached uniformly. This feature is obtained in part, by comminution of the pulp into discrete floc particles of a size which is of a sufficiently small diameter and of a sufficiently low bulk density so that the ozone gas mixture will completely penetrate a majority of the fiber flocs, i.e., which comprise agglomerations of fibers. During comminution it is not feasible to completely separate the pulp fibers into distinct fibers. In general, the floc particles resulting from comminution have a relatively compacted central core surrounded by a plurality of outwardly extending fibers. For purposes of this invention, the floc particle size is determined by measuring what was determined to be the smallest diameter of this relatively unfluffed central core.

Bleaching uniformity is to a large extent also dependent on certain of the other process parameters, but it has been found that if the floc particle size is limited to a maximum of 5 mm, and preferably even less—for example, 3 mm—that uniform treatment of a substantial majority of these particles can readily be achieved, as evidenced by observation of an insignificant number of darker underbleached floc centers. Where the floc particle size was greater than about 5 mm, bleaching was non-uniform, as evidenced by a majority of darker unbleached floc centers. Therefore it is important to achieve sufficient comminution so that a majority of the flocs measure below an average of about 5 mm for uniform ozone treatment thereof.

A still further important process parameter is that during the ozone bleaching process the particles to be bleached should be exposed to the ozone bleaching mixture by mixing so as to allow access of the ozone gas mixture to all surfaces of the flocs and equal access of the ozone gas mixture to all flocs. The mixing of the pulp in the ozone gas mixture gives superior results with regard to uniformity as compared to the results obtained with a static bed of flocs wherein some of the flocs are isolated from the ozone gas relative to other flocs and thereby bleached less than other flocs.

The movement of the flocs so as to expose them to the ozone gas mixture causes uniform treatment of the flocs with respect to each other. This treatment results in the desired amount of lignin being removed uniformly from the pulp without excessive deterioration of the cellulose in the fibers which comprise the flocs. The control of the ozone treatment in accordance with this invention by use of a controlled particle size and by turbulent movement during ozone treatment has been found to result in a final pulp typically having less than about a 5% variation in GE brightness, K No. and viscosity. In comparison, if the treatment is non-uniform, as typically occurs in static bed reactors (that is, reactors wherein the particles are not agitated during ozone treatment), some portions of the bed are substantially over-bleached while other portions remain relatively unreacted because the flow of the ozone gas mixture through the static bed reactor is not uniform.

Treating pulp at high consistencies with ozone without paying particular attention to the comminution of the pulp fibers or to the proper contact between the individual fibers and the reactant gas stream invariably results in a non-uniform ozone bleaching of the fibers. The present application designates such a non-uniform ozone treatment with the letter "Z". The use of a modified ozone technique according to the present invention, as discussed above, in which the fibers are comminuted to a size of about 5 mm or less and are properly and uniformly contacted with the ozone gas stream, has been designated herein as "$Z_m$".

Pulp exiting the ozone reactor has a GE brightness of about at least 50 percent and generally around 50 to 70 percent, with hardwoods usually being above about 55 percent. The pulp (for hardwoods or softwoods) also has a K No. of between about 3 and 4 (target of 3.5), which is entirely satisfactory for pulp at this stage of the process.

Figure 3:
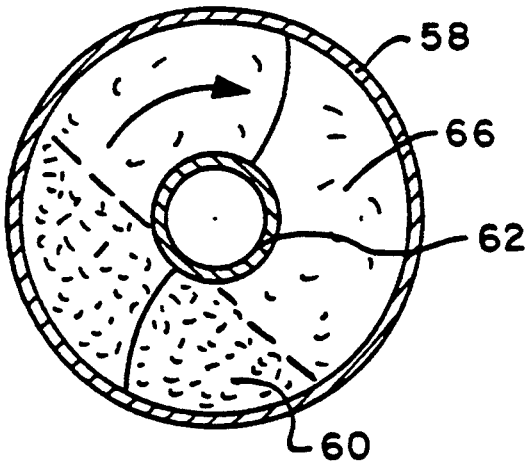
FIG. 3 is a cross-sectional drawing of a portion of an ozonation apparatus shown in FIG. 2, taken along line 3—3.
Figure 3A:
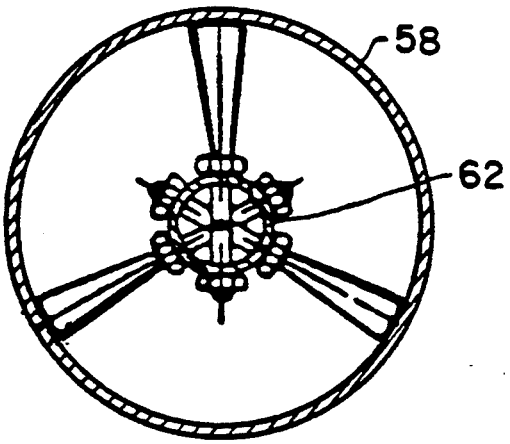
FIG. 3A is a cross-sectional drawing of a portion of a preferred ozonation apparatus shown in FIG. 2, taken along line 3—3.

An apparatus which is especially suitable for ozone bleaching in accordance with the present invention is illustrated in FIGS. 2, 3 and 3A. As described above, washed pulp 36 is directed to mixing chest 40 where it is treated with an acid 42 and a chelating agent 44. The acidified, chelated low-consistency pulp 46 is introduced into thickening unit 48 for removing excess liquid 50 from the pulp, such as a twin roll press wherein the consistency of the pulp is raised to the desired level. At least a portion of this excess liquid 50 may be recycled to mixing chest 40, with a remaining portion being directed to blow tank 32. The resulting high consistency pulp 52 is then passed through screw feeder 54 which acts as a gas seal for the ozone gas and thereafter through a comminuting unit 56, such as a fluffer, where the pulp is comminuted to pulp fiber flocs 60 of a predetermined size which, as noted above, should measure about 5 mm or less in size. The comminuted particles are then introduced into a dynamic ozone reaction chamber 58 which, as illustrated, is a conveyor 62 powered by motor 64. Conveyor 62 is specifically designed for mixing and transporting the pulp particles 60 so as to allow the entire surface of the particles to become exposed to the ozone gas mixture 66 during movement of the pulp. As further shown in FIG. 2, pulp fiber flocs 60 after treatment are allowed to fall into dilution tank 68.

FIG. 3 is a cross-sectional view through ozone reactor 58 illustrating the arrangement of the pulp particles 60 as they are carried through the reactor by conveyor 62. FIG. 3A is a cross-sectional view of a preferred conveyor utilizing a paddle-like arrangement to move the comminuted particles through reaction chamber 58.

The process in FIG. 2 shows the pulp being treated with ozone cocurrently with the ozone-gas mixture. Alternately, however the portion of the pulp which has been bleached to the greatest extent may initially be contacted with the newly introduced ozone mixture containing the maximum amount of ozone by passing the ozone-containing gas in a direction counter-current to the flow of pulp 60. The pulp entering the reactor has the highest lignin content and initially contacts the exiting, nearly exhausted ozone mixture, thereby providing the optimum chance to consume virtually all of the ozone. This is an efficient method for stripping ozone from the ozone/oxygen or ozone/air mixture.

When the ozone 66 is contacted with the pulp in a cocurrent manner, as shown in FIG. 2, the remaining spent ozone gas 70 can be recovered from dilution tank 68. In tank 68, dilution water 72, which also serves as an ozone gas seal, is added to reduce the consistency of the pulp to a low level to facilitate movement of the bleached pulp 74 through the subsequent process steps.

The spent ozone gas 70 from dilution tank 68 is directed to a carrier gas pretreatment stage 76 where a carrier gas 78 of oxygen or air is added. This mixture 80 is directed to ozone generator 82 where the appropriate amount of ozone is generated to obtain the desired concentration. The proper ozone/air mixture 66 is then directed to ozone reactor 58 for delignification and bleaching of the pulp.

After completion of the ozone bleaching step, the substantially delignified pulp 74 is again thoroughly washed in washer 84 as shown in FIG. 2 and at least a portion of the water 86 which is recovered is recycled to washing unit 34 of the process, thereby producing major environmental benefits from the elimination of sewered liquid.

The bleached low consistency pulp 74 after ozonation will have a reduced amount of lignin, and therefore, a lower K No. and an acceptable viscosity. The exact values for the K No. and the viscosity which are obtained are dependent upon the particular processing to which the pulp has been subjected. For example, a southern U.S. softwood pulp which is pulped with a conventional Kraft method, initially delignified by modified high consistency oxygen delignification ($O_m$), and subsequently further delignified with ozone, preferably by a modified uniform ozone treatment ($Z_m$), will typically have a K No. of about 3–4 and a viscosity of about 10. Southern U.S. softwood pulp which is subjected to Kraft AQ pulping and then to modified high consistency oxygen bleaching ($O_m$) and modified uniform ozone treatment ($Z_m$) will typically have a K No. of about 2 and a viscosity of greater than about 12.

The resulting pulp 74 will be noticeably brighter than the starting pulp. For example, southern softwood, after the pulping process, has a GE brightness of about 15% to 25%; after the oxygen bleaching process, a GE brightness of about 25% to 45%; and after the ozone bleaching process, a GE brightness of about 50% to 70%.

4. Alkaline Extraction

The washed pulp 88 from the ozone stage is then combined with a sufficient amount of alkaline material 90 in extraction vessel 92 to effect extraction. Thus, pulp 88 is subjected to an aqueous alkaline solution for a predetermined time and at a predetermined temperature correlated to the quantity of alkaline material to solubilize a substantial portion of any lignin which remains in the pulp, in vessel 92. This extraction-process also increases the brightness of the pulp, typically by about 2 GE brightness points. Thereafter, the alkali treated pulp 94 is directed to washing unit 96, the aqueous alkaline solution is washed from the pulp so as to remove substantially all of the solubilized lignin from the pulp, thus forming a substantially lignin-free pulp. This step is well known to those skilled in the art and no further comment is deemed necessary here. The examples illustrate the preferred extraction parameters for this step of the process. At least a portion of the alkaline solution 98 which is recovered is recycled to washing unit 84. Again, major environmental benefits are achieved from the elimination of sewering of this solution.

In some cases, particularly where higher final brightnesses are targeted, the extraction step can be augmented by incorporating an oxygen treatment within the caustic extraction step ($E_o$). This alternative, also well known to those skilled in the art, requires no further comment here.

5. Additional Bleaching Stages

For most papermaking purposes, a final brightness in the range of 50 to 65 is unsatisfactory. Accordingly, in order to further raise the GE brightness to the more desirable range of about 70 to 95%, the pulp is subjected to brightening bleaching, which is primarily intended to convert the chromophoric groups on the lignin remaining in the pulp into a colorless state.

After extracting and rewashing the pulp, the brightening bleaching of the ozone-bleached and extracted pulp can be performed using a variety of materials. As illustrated in FIG. 2, the washed pulp 100 is combined with the chosen bleaching agent 102 in bleaching vessel 104. The preferred bleaching agent is chlorine dioxide or peroxide. After bleaching, the pulp 106 is washed with water 114 in washing unit 108 and the effluent is either recycled 110 or sewered 112. When recycled, at least a portion of wash water stream 110 is directed to washing unit 96. The resultant bleached pulp 116 may then be collected and used in a variety of applications.

One of the principal materials which has heretofore been used, and which is generally highly effective, is chlorine dioxide (D) (see FIG. 1). In accordance with the invention, an appropriate amount of chlorine dioxide enables high-strength pulps having a GE brightness value greater than about 80% to be obtained. Since the pulps entering the chlorine dioxide stage are relatively low in lignin, the chlorine dioxide brightening bleaching can be carried out in the presence of only from about 0.25% to about 1% of chlorine dioxide based on the oven dry weight of the pulp.

The chlorine dioxide which is utilized in the brightening process should preferably be prepared by a process which is free from elemental chlorine. Alternatively, however, and less preferably, chlorine dioxide which does contain a minor amount of elemental chlorine can be used without any substantial increase in the relative amount of undesirable pollutants because of the relatively low amount of lignin present in the ozone-bleached pulp. The effluent from the final bleaching step of this invention when using chlorine dioxide is exceptionally low and can be discharged safely as shown in FIG. 2.

If sewering of the effluent from the final chlorine dioxide bleaching step is unacceptable, the stream can, however, be further purified by being treated with a membrane filtration process such as reverse osmosis. This technique provides a clean filtrate that can be recycled back to previous bleaching stages for further use. This has the benefit of reducing fresh water usage. Moreover, the concentrated chloride streams that result from the membrane filtration are relatively low in volume.

There may be some cases when extremely high pulp brightnesses are desired, for example, 92–95% GEB, where additional stages of bleaching may be required. An additional extraction and chlorine dioxide treatment would be a common choice, thereby creating a $O_mZ_m$EDED bleach sequence.

Instead of using chlorine dioxide for final brightening, the brightening bleaching may be conducted with hydrogen peroxide, as also shown in FIG. 1. This technique provides a completely chlorine-free bleaching cycle (such as an $O_mZ_m$EP sequence), wherein no chlorinated materials are formed in the bleaching process and the liquid extraction product can be readily recycled without the necessity for cumbersome filtration techniques. When utilizing peroxides as the bleaching agent, however, the K No. of the pulp from either softwood or hardwood should be reduced to a level of about 6 prior to the ozonation step in order to obtain, as a final product following the peroxide bleaching stage, a pulp of acceptable brightness, i.e., a GE Brightness of greater than about 80%, since peroxide is not as effective at bleaching as is chlorine dioxide. Where a completely chlorine/chlorine dioxide-free process is desired, however, peroxide provides acceptable results.

Typical peroxide brightening agents and their use in this step are conventional, and one skilled in the art would know the appropriate concentration, types and use of such peroxide agents. Hydrogen peroxide is preferred.

The washed, further brightened pulp has a GE brightness of between about 70 and 95%, and preferably between about 80 and 95%. Also, the physical properties of this pulp are commensurate with those obtainable by pulp produced by conventional CEDED or OC/DED processes.

6. Washing Effluent Recycle

In any pulp process, filtrate management is an important factor in the overall economy or cost of operation of the process. The water which is used in the process requires both access to a suitable source and treatment of the effluent prior to discharge.

In an effort to reduce the water demand of the process, it is-desirable to recycle as much of the effluent as possible. This practice cannot be used with processes utilizing chlorine or multiple steps of chlorine dioxide, since the effluents produced by these processes contain large amounts of chlorides produced by the by-products of such chemicals. Thus, recycling these effluents causes a build-up of chlorides which, in turn, causes either corrosion of processing equipment or the use of expensive materials of construction. In addition, such recycled effluents require substantial treatment before these effluents can be discharged from the mill, thus requiring further expenditures for equipment and treatment chemicals.

Figure 4:
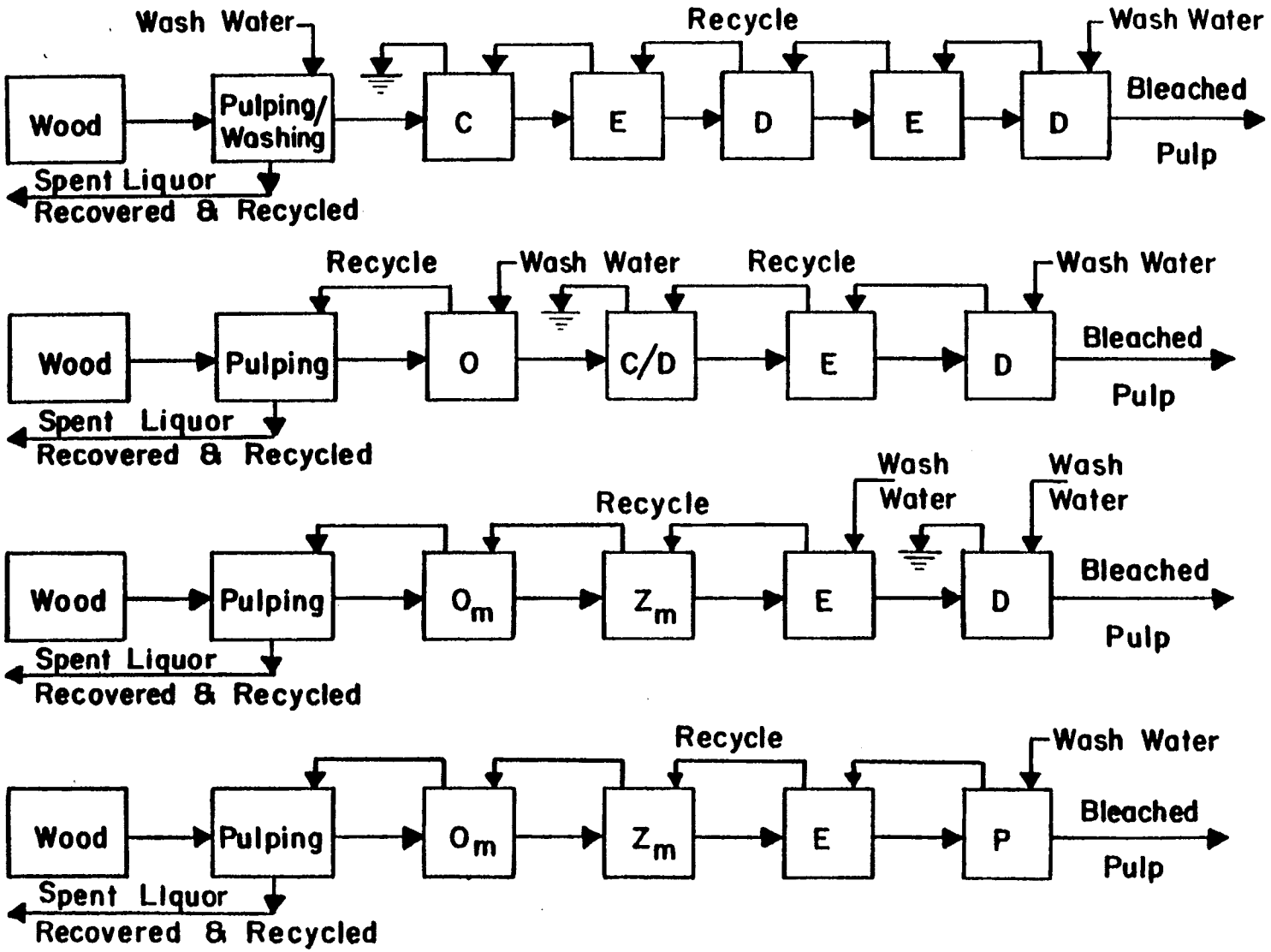
FIG. 4 is a comparison of the recycle and waste streams for a variety of pulp treatment processes.

As illustrated in FIG. 4, use of either the conventional CEDED process or the OC/DED technique results in a significant disposal problem with regard to the effluents produced from the washing steps due to the high levels of chloride-containing compounds found therein. As noted above, these streams cannot be recycled, and are preferably treated before discharge into the environment. Recycling of effluent could be used to decrease the amount of water used, but then the process equipment may be subject to increased corrosion rates due to the increased chloride level in the recycled effluent.

In contrast, however, use of the $O_mZ_m$ED process of the invention results in formation of only a minimal amount of chlorinated material in the wash water, which water can be safely discharged, i.e., sewered, within most environmental protection standards. Alternately, this effluent may be treated by reverse osmosis to provide an even cleaner filtrate that may be recycled to previous bleaching stages as shown for further use without the build-up of chlorides. When a D bleaching stage is desired, steps may be taken to reduce the demand for chlorine dioxide. An $E_o$ step may allow the pulp to achieve greater levels of brightness although additional expense is incurred by the use of additional sodium hydroxide and oxygen in this step. Also, there are known industry procedures for preparing chlorine dioxide whereby residual chlorine levels are minimized (e.g., the R8 process vs. the R3 process). These reduced chlorine level chemicals are preferred for use in the D stage to reduce the chloride levels of the wash water effluent.

Instead of $O_mZ_mED$, one may use the $O_mZ_mEP$ process of the invention to obtain additional substantial advantages over the prior art in that no chlorinated compounds whatsoever are produced. This enables all of the effluent to be recycled without experiencing the problems of chloride build-up in the process wash water streams.

Accordingly, the process of the present invention achieves substantial advantages with respect to reductions in effluent volume, color, COD, BOD and chlorinated organics. Moreover, since the effluent used in the washing steps contains significantly reduced chloride levels compared to prior art processes which utilize chlorine, the washing unit vents will not be carrying chlorinated organic compounds or gases which require treatment prior to discharge.

EXAMPLES

The scope of the invention is further described in connection with the following examples which are set forth for purposes of illustration only and which are not to be construed as limiting the scope of the invention in any manner. Unless otherwise indicated, all chemical percentages are calculated on the basis of the weight of oven dried (OD) fiber. Also, one skilled in the art would understand that the target brightness values do not need to be precisely achieved, as GEB values of plus or minus 2% from the target are acceptable. In all the examples having a D stage, except Example 11, an R-3 type of chlorine dioxide solution, known to contain a 6:1 ratio of dioxide to elemental chlorine, was used.

EXAMPLE 1 (Comparative)

Loblolly pine chips were lab batch cooked according to the conditions in Table I to produce a conventional kraft pulp. The resulting pulp had a K No. of 22.6 and a viscosity of 27.1 cps. The kraft pulp was then subjected to conventional oxygen treatment (Tables II and V) followed by bleaching to a final target brightness of 83 GEB using both a conventional OC/DED sequence (Table III) and an $OZ_mED$ bleaching sequence (Tables IV and V). The ozone bleaching stage was run at 35% consistency with an ozone application of 0.61%.

TABLE I

LOBLOLLY PINE KRAFT PULPING CONDITIONS

| CONDITION/STEP | PARAMETER |
|---|---|
| PRESTEAM TIME (min.) | 2.5 |
| TIME TO TEMPERATURE - 175° C. | 1 hour |
| TIME AT TEMPERATURE - 175° C. | 1 hour |
| LIQUOR:WOOD ratio | 4:1 |
| SULFIDITY (%) | 25.8 |
| ACTIVE ALKALI (%) | 17.4 |
| % AA FROM BLACK LIQUOR FILLBACK | 0.43 |
| K NO. | 22.6 |
| VISCOSITY (cps) | 27.1 |

TABLE II

PINE TYPICAL CONVENTIONAL O STAGE BLEACHING CONDITIONS

| PRESSURE (PSIG) | % CHEMICAL | pH | TEMP (°C.) | PULP CONSISTENCY (%) |
|---|---|---|---|---|
| 80 | 2.5 NaOH<br>0.1 $MgSO_4$ | 10.2 | 110 | 27* |

*both for alkali addition and oxygen delignification

TABLE III

PINE TYPICAL C/DED BLEACHING CONDITIONS

| STEP | CHEMICAL (%) | pH | TEMP (°C.) | PULP CONSISTENCY (%) |
|---|---|---|---|---|
| C/D | 3.6 $Cl_2$<br>0.6 $ClO_2$ | 1.8 | 50 | 3.15 |
| E | 1.5 NaOH | 11.6 | 70 | 12 |
| D | 0.3 $ClO_2$ | 4.2 | 60 | 12 |

TABLE IV

PINE TYPICAL ACIDIFICATION CONDITIONS

| STEP | % CHEMICAL | pH | TEMP (°C.) | PULP CONSISTENCY (%) |
|---|---|---|---|---|
| Acidification ($H_2SO_4$) | to pH 2 | 2 | 22 | 3–4 |
| Chelation (oxalic acid) | 0.11 | 2 | 22 | 3–4 |

TABLE V

PINE TYPICAL $Z_mED$ BLEACHING CONDITIONS

| STEP | CHEMICAL (%) | pH | TEMP. (°C.) | PULP CONSISTENCY (%) |
|---|---|---|---|---|
| Z (Ozone) | 0.2 to 1 | 2 to 4 | 22 | 35–45 |
| E | 1.5 NaOH | 11.5 | 70 | 12 |
| D | 1.0 $ClO_2$ | 4.2 | 60 | 12 |

As shown in Table VI and VII below, $OZ_mED$ bleaching under these conditions produced a pulp having acceptable strength properties compared to an 83% GE target brightness OC/DED baseline pulp. Under these conditions, the $OZ_mED$ pulp had marginal viscosity of 9.7 cps. The strength properties were measured on an $OZ_mED$ pulp where the final D-stage application was 2.5%. Target brightness was reached only with an excessive chlorine dioxide charge. The $OZ_mE$ pulps response to chlorine dioxide treatment shows that higher brightness can only be achieved by significantly increasing the ozone application, which then causes significant viscosity and strength loss of the pulp.

TABLE VI

PINE KRAFT OC/DED AND KRAFT $OZ_mED$ PROPERTIES COMPARISON

| OC/DED | | | $OZ_mED$ | | |
|---|---|---|---|---|---|
| CSF* | TEAR FACTOR | BREAKING LENGTH | CSF* | TEAR FACTOR | BREAKING LENGTH |
| 646 | 205 | 6.54 | 659 | 228 | 5.85 |
| 508 | 142 | 8.46 | 492 | 147 | 8.49 |
| 351 | 145 | 8.81 | 334 | 126 | 8.50 |
| 178 | 129 | 8.43 | 197 | 121 | 8.54 |

*Canadian Standard Freeness

TABLE VII

| PINE KRAFT $OZ_mED$ BRIGHTNESS RESPONSE | | | | | | | | |
|---|---|---|---|---|---|---|---|---|
| $ClO_2$ (%) | 0 | 1.3 | 1.5 | 1.7 | 1.9 | 2.2 | 2.5 | 2.8 |
| Brightness (GEB %) | 48.0 | 61.3 | 76.1 | 79.4 | 81.0 | 81.8 | 83.9 | 83.9 |

EXAMPLE 2

A kraft/AQ brownstock was prepared in a laboratory batch digester from loblolly pine chips as described in Table VIII. The K No. of the resulting brownstock was 18.3 and the viscosity was 20.6 cps. The Kraft/AQ pulping conditions produced a pulp having a significantly lower lignin content than in Example 1 as evidenced by the K No., without unacceptable deterioration of pulp strength as evidenced by the viscosity.

TABLE VIII

| LOBLOLLY PINE KRAFT/AQ PULPING CONDITIONS | |
|---|---|
| CONDITION/STEP | PARAMETER |
| PRESTEAM TIME (min.) | 2.5 |
| TIME TO TEMPERATURE - 175° C. | 1 hour |
| TIME AT TEMPERATURE - 175° C. | 1 hour |
| LIQUOR:WOOD ratio | 4:1 |
| SULFIDITY (%) | 25.3 |
| ACTIVE ALKALI (%) | 18.0 |
| % AA FROM BLACK LIQUOR FILLBACK | 0.43 |
| AQ - % ON WOOD | 0.025 |
| K NO. | 18.3 |
| VISCOSITY | 20.6 |

The Kraft/AQ brownstock was then subjected to further bleaching using the conventional OC/DED sequence and the $OZ_mED$ sequence as shown in Tables II, III, IV and V to a target brightness of 83% GEB. Use of the Kraft AQ pulping technology achieved the goal of producing a starting pulp with a low K No., having acceptable viscosity properties, for the ozone bleaching sequence. The ozone bleaching stage was run at 35% consistency with an ozone application of 0.35% and 1.6% $ClO_2$ was used in the final D stage to reach target brightness.

As shown in Tables IX and X below, the optical properties as measured by brightness response in the final chlorine dioxide stage were improved and strength properties were acceptable compared to the OC/DED baseline.

TABLE IX

| PINE KRAFT/AQ OC/DED AND $OZ_mED$ PROPERTIES COMPARISON | | | | | |
|---|---|---|---|---|---|
| OC/DED | | | $OZ_mED$ | | |
| CSF | TEAR FACTOR | BREAKING LENGTH | CSF | TEAR FACTOR | BREAKING LENGTH |
| 658 | 194 | 6.02 | 650 | 194 | 6.29 |
| 524 | 139 | 8.14 | 497 | 159 | 7.83 |
| 352 | 128 | 8.92 | 334 | 130 | 8.34 |
| 190 | 119 | 8.74 | 211 | 121 | 8.59 |

TABLE X

| PINE KRAFT/AQ $OZ_mED$ BRIGHTNESS RESPONSE | | | | | | |
|---|---|---|---|---|---|---|
| $ClO_2$ (%) | 0 | 0.8 | 1.2 | 1.6 | 2.0 | 2.4 |
| Brightness (GEB %) | 52.9 | 76.8 | 80.7 | 83.2 | 83.4 | 83.8 |

EXAMPLE 3 (Comparative)

A pine Kraft brownstock having a K No. of about 24 was pressed to a consistency of about 30–36% by weight to produce a high consistency mat. The mat of brownstock was sprayed with a 10% sodium hydroxide solution in an amount sufficient to produce approximately 2.5 weight percent sodium hydroxide based on pulp dry weight. Dilution water was added in an amount sufficient to adjust the brownstock mat to about 27% consistency. The high consistency brownstock mat was then subjected to oxygen delignification using the following conditions: 110° C., 30 minutes, 80 psig $O_2$.

EXAMPLE 4

Pine Kraft brownstock of Example 3 was introduced into a treatment vessel along with a sufficient volume of 10% NaOH solution to effect a 30% NaOH addition based on oven-dried pulp. Sufficient dilution water was added to obtain a brownstock consistency of about 3% by weight in the treatment vessel. The brownstock and the aqueous sodium hydroxide solution were uniformly mixed at room temperature by a ribbon mixer for about 15 minutes. The treated brownstock was then pressed to a consistency of about 27% by weight. After pressing, the sodium hydroxide on the fiber equaled about 2.5% as in Example 3. The treated brownstock was then delignified according to the oxygen delignification procedure described in Example 3. A comparison is shown in Table XI.

TABLE XI

| COMPARISON OF OXYGEN STAGE BLEACHING RESULTS ON PULPS PRODUCED BY EXAMPLES 3 AND 4 | | |
|---|---|---|
| | EXAMPLE 3 (O) | EXAMPLE 4 ($O_m$) |
| K No. | 13 | 9 |
| Viscosity (cps) | 14.8 | 14.0 |

As can be seen from a comparison of Examples 3 and 4, a preferred method of the present invention of using a low consistency alkali addition followed by a high consistency oxygen treatment ($O_m$) produced a bleached brownstock having greater delignification (lower K No.) than the prior art methods, without any substantial change in strength properties.

As a result of the lower K No. pulp produced by this process, subsequent bleaching steps can be adjusted to accommodate the higher brightness, lower lignin containing pulp. Thus, the bleaching stages for such pulp require less bleaching agents or shorter bleaching times than for pulp which is not treated according to the present invention.

EXAMPLE 5

Pulp produced from pine in accordance with the $O_m$ process of Example 4 of the present invention is compared to that produced conventionally (O) (i.e., with no low consistency alkaline treatment step). The average caustic dosage for high consistency oxygen delignification of brownstock pulp was found to be 45 pounds per oven dried ton (lb/t) or 2.3%. At that level, the average reduction in K No. across the oxygen delignification reactor was 10 units. For the same level of caustic applied to pulp according to a preferred treatment step, an average K No. drop during delignification was found to be 13 units: a 30% improvement compared to the conventional process.

This advantage in delignification selectivity can also be shown by a comparison of pulp viscosity. The average K No. and viscosity for conventional pulp was 12.1 and 14.4 cps, respectively. For the preferred treatment process of the invention, the average K No. at essentially the same viscosity (14.0 cps) was 8.3.

Delignification selectivity can also be expressed as the change in viscosity versus the change in K No. between brownstock and the corresponding treated pulps. Oxygen delignification selectivity decreases rather rapidly when the change in K No. begins to exceed 10 K No. units. The decrease in selectivity is observed as a rapid increase in the change in viscosity for a given change in K No. As an example, for a change in K No. of 12 units, the corresponding change in viscosity is expected to be 12 to 13 cps. By contrast, for the same change in K No. (12) obtained by delignified pulps which have been treated using the preferred method, the change in viscosity was found to be about 6 cps. The change in viscosity per change in K No. appears to be constant up to a 16 to 17 K No. unit change for pulps obtained using the preferred treatment process of the invention. The results are shown in Table XII.

TABLE XII

PINE KRAFT PULP PROPERTY COMPARISON

| | Conventional Oxygen Treatment (O) | Modified Oxygen Treatment ($O_m$) |
|---|---|---|
| Unbleached Pulp | | |
| K No. | 21.9 | 20.5 |
| Viscosity (cps) | 21.5 | 20.5 |
| Ratio of K No./Viscosity | 1.02 | 1.0 |
| Oxygen Delignification Stage Pulp | | |
| K No. | 12.1 | 8.3 |
| Viscosity (cps) | 14.4 | 14.0 |
| Ratio of K No./Viscosity | 0.84 | 0.59 |
| Caustic, lb/t | 39.4 | 46.0 |
| Delignification (%) | 44.7 | 59.5 |

EXAMPLE 6

A southern pine pulp was produced in an operating 600 TPD fine paper mill using the modified oxygen delignification process ($O_m$) having the conditions of Table II in combination with the uniform alkali treatment as described in Examples 4 and 5 and the conditions as shown in Table XIII below. The O-stage pulp produced by this novel method had the properties needed to successfully complete the bleaching process using ozone, as described in the embodiment of this invention. The oxygen stage pulp had a K No. of 7.9 (compared to a typical conventional O-stage K No. of about 12). Viscosity of the delignified pulp was 15 cps and was not significantly reduced by the high degree of delignification obtained by the use of the modified oxygen process. This pulp could then be further bleached with ozone, utilizing any of the numerous process embodiments described herein to produce a pulp having acceptable final strength and optical properties.

C/DED bleaching of this pulp was completed in the laboratory, as described in Table XIV, to provide a baseline for comparison of properties.

TABLE XIII

TYPICAL MODIFIED OXYGEN ($O_m$) STAGE CONDITIONS

| STEP | % CHEMICAL USED ON OLD FIBERS | pH | TEMP (°C.) | PULP CONSISTENCY (%) |
|---|---|---|---|---|
| Treatment (NaOH) | 30% | — | 22 | 3–4 |
| Oxygen | | | | |
| ($O_2$) | 80 psig | 10.2 | 110 | 27 |
| ($MgSO_4$) | 0.1 | | | |

TABLE XIV

PINE KRAFT C/DED BLEACHING CONDITIONS

| STEP | CHEMICAL (%) | pH | TEMP. (°C.) | PULP CONSISTENCY (%) |
|---|---|---|---|---|
| C/D | 2.4 $Cl_2$<br>0.4 $ClO_2$ | 1.8 | 50 | 3.15 |
| E | 1.05 NaOH | 11.5 | 70 | 12 |
| D | 0.23 $ClO_2$ | 4.2 | 60 | 12 |

The ozone bleaching stage was carried out in a pilot plant reactor as shown in FIG. 2. Conditions of operation of the pilot plant reactor are shown in Table XV.

TABLE XV

PILOT PLANT REACTOR TYPICAL OPERATING CONDITIONS

| OPERATING PARAMETER | VALUE OR CONDITION |
|---|---|
| Gas and pulp flows | Cocurrent |
| Operating rate | 6.5 OD TPD* |
| Gas flow rate | 58 scfm |
| Pulp consistency | 42% |
| Ozone application (Note: increased ozone amount used due to pulp containing dissolved solids that consume ozone) | 1.18% |
| Pulp residence time | 1 minute |
| $Z_m$ stage K No. | 3.9 |
| $Z_m$ stage viscosity | 11.8 cps |
| $Z_m$ stage brightness | 55% GEB |

*oven dried tons per day

The ozone bleached pulp generated in the pilot plant reactor was then treated in extraction and chlorine dioxide stages in the laboratory, as described in Table V above, to produce a final bleached pulp product at target brightness. A final D stage charge of only 1.0% $ClO_2$ was used on the fiber.

The strength and optical properties of the ozone bleached pulp were acceptable compared to the conventional OC/DED baseline and the results of the comparison are shown in Tables XVI and XVII below.

TABLE XVI

PINE $O_mC$/DED and $O_mZ_m$ED PROPERTIES COMPARISON

| $O_mC$/DED | | | $O_mZ_m$ED | | |
|---|---|---|---|---|---|
| CSF | TEAR FACTOR | BREAKING LENGTH | CSF | TEAR FACTOR | BREAKING LENGTH |
| 656 | 147 | 6.80 | 659 | 177 | 5.57 |
| 511 | 113 | 8.00 | 510 | 146 | 6.93 |
| 335 | 96 | 8.69 | 367 | 111 | 7.90 |
| 217 | 101 | 8.69 | 178 | 100 | 8.20 |

TABLE XVII

| Pine $O_mZ_mED$ BRIGHTNESS RESPONSE | | | |
|---|---|---|---|
| $ClO_2$ (%) | 0 | 0.5 | 1.0 |
| Brightness (GEB %) | 55.0 | 70.0 | 84.2 |

EXAMPLE 7

To further exemplify the utility and range of applicability of the process of this invention, a southern hardwood fiber, from mixed hardwood comprising predominantly gum and oak, was bleached with ozone in the pilot plant described in Example 6 above. A conventional oxygen stage pulp produced in the 600 TPD mill was treated with ozone in the pilot plant reactor. The oxygen stage pulp had a K No. of 5.7 and a viscosity of 14.1.

A portion of the O stage pulp was final bleached by the conventional C/DED sequence in the laboratory to provide a baseline for comparison. The C/DED conditions are shown in Table XVIII.

TABLE XVIII

| HARDWOOD TYPICAL C/DED BLEACHING CONDITIONS | | | | |
|---|---|---|---|---|
| STEP | CHEMICAL (%) | pH | TEMP. (°C.) | PULP CONSISTENCY (%) |
| C/D | 1.61 $Cl_2$<br>0.26 $ClO_2$ | 1.8 | 50 | 3.15 |
| E | 1.0 NaOH | 11.9 | 70 | 12 |
| D | 0.35 $ClO_2$ | 4.2 | 60 | 12 |

The ozone reactor treatment conditions are shown in Table XIX. The pilot plant $Z_m$ stage pulp was then final bleached by conventional E and D stages as shown in Table XX to a target brightness. A D-stage $ClO_2$ charge of only 0.35% was used on OD fiber. Strength and brightness properties were acceptable compared to the baseline as shown in Tables XXI and XXII.

TABLE XIX

| HARDWOOD PILOT PLANT REACTOR OPERATING CONDITIONS | |
|---|---|
| OPERATING PARAMETER | VALUE OR CONDITION |
| Gas and pulp flows | Cocurrent |
| Operating rate | 9 OD TPD |
| Gas flow rate | 60 scfm |
| Pulp consistency | 36% |
| Ozone application (Note: increased ozone amount used due to pulp containing dissolved solids that consume ozone) | 0.86% |
| Pulp residence time | 1 minute |
| $Z_m$ stage K No. | 2.5 |
| $Z_m$ stage viscosity | 11.9 |
| $Z_m$ stage brightness | 63% GEB |

TABLE XX

| ED TYPICAL BLEACHING CONDITIONS USED ON $OZ_m$ HARDWOOD PULP | | | | |
|---|---|---|---|---|
| STEP | CHEMICAL (%) | pH | TEMP. (°C.) | PULP CONSISTENCY |
| E | 1.0 NaOH | 12.0 | 70 | 12 |
| D | 0.35 $ClO_2$ | 4.36 | 60 | 12 |

TABLE XXI

| HARDWOOD OC/DED AND $OZ_mED$ PROPERTIES COMPARISON | | | | | |
|---|---|---|---|---|---|
| OC/DED | | | $OZ_mED$ | | |
| CSF | TEAR FACTOR | BREAKING LENGTH | CSF | TEAR FACTOR | BREAKING LENGTH |
| 526 | 89.9 | 4.41 | 515 | 88.3 | 4.52 |
| 399 | 87.2 | 5.71 | 419 | 82.0 | 5.65 |
| 262 | 79.5 | 6.26 | 293 | 70.5 | 6.56 |
| 208 | 72.0 | 6.46 | 187 | 64.3 | 6.87 |

TABLE XXII

| HARDWOOD $OZ_mED$ BRIGHTNESS RESPONSE | | |
|---|---|---|
| $ClO_2$ (%) | 0 | 0.35 |
| Brightness (GEB %) | 64.0 | 84.4 |

EXAMPLE 8

Comparison tests similar to Example 5 were carried out for laboratory produced Kraft hardwood pulp, from mixed hardwood comprising predominantly gum and oak. Again, it was found that a significantly larger K No. drop across the oxygen delignification reactor using the modified oxygen process ($O_m$) is achieved compared to conventional oxygen processing (O). The average caustic dosage for hardwood was 27 lb/t, or 1.4%. This produced a K No. drop of about 5 units during the oxygen step. For the same level of caustic utilized according to the modified oxygen process of the present invention, an average K No. drop of about 7.3 units was obtained, an increase of almost 50%.

This advantage in delignification selectivity can also be shown by comparing pulp viscosity. The average hardwood K No. and viscosity were found to be 7.6 and 16 cps, respectively. For the invention, a K No. of 6 and a viscosity of 17.7 was obtained. Also, the K No. at the same viscosity as the non-treated pulp (16 cps), was found to be 5.8.

Delignification selectivity can also be expressed in terms of the change in viscosity versus the change in K No. between brownstock and the corresponding modified oxygen treated pulps. In comparing pulps which are conventionally oxygen treated with those of the invention, there is a greater decrease in delignification selectivity for increased degrees of delignification. For a change in K No. of 4 units, the average change in viscosity was 4 cps for pulps produced by the conventional process. By contrast, the change in K No. for the same change in viscosity for pulps produced by the modified oxygen method was 7 units. Expressed in terms. of a delignification selectivity ratio, the selectivity for the modified method was 1.8 K No./cps and that for the conventional process was 1 K No./cps, an increase of 80%. Results are shown in Table XXIII.

TABLE XXIII

| PULP PROPERTY COMPARISON (HARDWOOD) | | |
|---|---|---|
| | Conventional Oxygen Treatment (O) | Modified Oxygen Treatment ($O_m$) |
| Unbleached Pulp | | |
| K No. | 12.3 | 13.0 |
| Viscosity (cps) | 21.6 | 23.4 |
| Ratio of K No./Viscosity | 0.57 | 0.56 |
| Oxygen Delignification Stage Pulp | | |

TABLE XXIII-continued

| PULP PROPERTY COMPARISON (HARDWOOD) | | |
|---|---|---|
| | Conventional Oxygen Treatment (O) | Modified Oxygen Treatment ($O_m$) |
| K No. | 7.6 | 6.0 |
| Viscosity (cps) | 16.0 | 17.7 |
| Ratio of K No./ Viscosity | 0.47 | 0.33 |
| Caustic, lb/t | 27.6 | 26.4 |
| Delignification (%) | 38.0 | 54.0 |

EXAMPLE 9

A series of experiments were carried out in the pilot plant reactor using pulp from a 600 TPD fine paper mill with a conventional oxygen delignification stage (O). These experiments were performed to illustrate the effect of pH on the ozone bleaching process using southern hardwoods. Reactor operating conditions were held constant at the conditions shown in Table XXIV with the pH of the ozone stage being the only variable.

TABLE XXIV

| HARDWOOD PILOT PLANT REACTOR TYPICAL OPERATING CONDITIONS | |
|---|---|
| OPERATING PARAMETER | VALUE OR CONDITION |
| Gas and pulp flows | Cocurrent |
| Operating rate | 9 OD TPD |
| Gas flow rate | 40 scfm |
| Pulp consistency | 40% |
| Ozone application (Note: increased ozone amount used due to pulp containing dissolved solids that consume ozone) | 1% |
| Pulp residence time | 1 minute |

As can be seen from Table XXV below, the effect of pH on the ozone bleaching process is significant with lower pH beneficially improving the selectivity of the bleaching process.

TABLE XXV

| EFFECT OF pH ON HARDWOODS | | | | |
|---|---|---|---|---|
| PARAMETER | pH 5 | pH 4 | pH 3 | pH 2 |
| CHANGE IN K NO. ACROSS THE $Z_m$ STAGE | −2.79 | −3.17 | −3.16 | −3.67 |
| CHANGE IN BRIGHTNESS ACROSS THE $Z_m$ STAGE (GEB) | +12.1 | +15.0 | +11.7 | +17.4 |
| CHANGE IN VISCOSITY ACROSS THE $Z_m$ STAGE (cps) | −6.0 | −7.1 | −4.9 | −4.4 |

EXAMPLE 10

A number of comparative properties are of interest to illustrate the beneficial effects of producing fully bleached pulps using the $OZ_mED$ process. Typical operating data and effluent measurements were collected from operating mills using the CEDED and OC/DED bleaching sequences on Southern pine. These properties were compared to those of effluents produced by the $OZ_mED$ sequence, using the $OZ_mED$ pulp and effluent prepared in Example 1. For the conventional CEDED sequence see Table XXVI, for the conventional OC/DED sequence see Tables II and III above and for the $OZ_mED$ sequence see Tables IV and V above. It should be noted that the CEDED sequence effluent is the combined C, $E_1$, $D_1$, $E_2$ and $D_2$ effluent. The OC/DED effluent is the C/D, E and D combined effluent and the $OZ_mED$ effluent is the D stage effluent, each representing the several effluent properties. As shown in Table XXVII below, the ozone bleaching sequence substantially reduces the environmental impact of the effluent from the bleaching process. To determine color, EPA method 110.2 was used. From this data, it can be seen that the present invention provides a discharge effluent having a color of no greater than about 2 pounds per ton, a $BOD_5$ value of no greater than about 2 pounds per ton and an amount of total organic chloride of no greater than about 2 and preferably less than about 0.8.

TABLE XXVI

| PINE CEDED BLEACHING CONDITIONS | | | | |
|---|---|---|---|---|
| STEP | CHEMICAL (%) | pH | TEMP. (°C.) | PULP CONSISTENCY (%) |
| C | 5.3 $Cl_2$ | 4.10 | 40 | 3.15 |
| E | 3.25 NaOH | 11.3 | 70 | 12 |
| D | 1 $ClO_2$ | 3 | 60 | 12 |
| E | 0.6 NaOH | 11.6 | 70 | 12 |
| D | 0.12 $ClO_2$ | 3 | 60 | 12 |

TABLE XXVII

| COMPARISON OF CEDED, OC/DED AND $OZ_mED$ BLEACHING | | | |
|---|---|---|---|
| PARAMETER | CEDED | OC/DED | $OZ_mED$ |
| $BOD_5$ (lbs/ton) | 34 | 21 | 1 |
| Color (lbs/ton) | 367 | 83 | less than 1 |
| TOCl (lbs/ton) | 7 | 4 | 0.8 |

EXAMPLE 11

Southern pine kraft pulp was bleached using three modifications of the basic OZED sequence. In the first sequence ($OZ_mED$), the pulp was bleached as in Tables IV and V with conventional oxygen, modified ozone, caustic extraction and chloride dioxide as produced in the R-3 sequence with a $ClO_2/Cl_2$ ratio of 6:1. In the second sequence, the modified oxygen process ($O_m$) was utilized and again the final stage used an R-3 type of chlorine dioxide. In the third sequence, the modified oxygen process ($O_m$) was used once again, and an R-8 chlorine dioxide solution was employed with 95:1 ratio in the final stage. Table XXVIII demonstrates the positive environmental impact offered with the use of the modified oxygen process ($O_m$). The R-8 bleach liquor also had a positive effect.

TABLE XXVIII

| EFFLUENT FROM BLEACHING OF PINE KRAFT PULPS | | | |
|---|---|---|---|
| Sequence | $OZ_MED$ | $O_MZ_MED$ | $O_MZ_MED$ |
| Ratio $ClO_2/Cl_2$ in Last Stage | 6:1 | 6:1 | 95:1 |
| TOCl, lb/ton | 0.8 | 0.3 | 0.2 |

EXAMPLE 12

Southern loblolly pine pulps were prepared by the kraft and kraft/AQ pulping processes as described in Tables I and VIII above. These pulps were further subjected to conventional and modified oxygen delignification as described in Examples 4 and 5 to show the effect of combining these processes (for extending delignification with minimal impact on pulp strength) on the ozone bleaching sequence. As can readily be seen from Table XXIX, these processes produce an additive effect. Extremely low $O_mZ_mE$ K Nos. can be reached with little impact on final viscosity. Conversely, the amount of ozone needed to reach a target $O_mZ_mE$ K No. of about 3.5 for the previously described ozone bleaching process can be substantially reduced. In addition, the additive effect produces a southern pine pulp that can be fully bleached by an $O_mZ_mEP$ process where a very low $O_mZ_mE$ K No. is required for a functional peroxide stage.

TABLE XXIX

ADDITIVE EFFECTS OF KRAFT/AQ AND MODIFIED OXYGEN ($O_m$) PINE PULPS

| PARAMETER | KRAFT + O (Prior Art) | KRAFT/ AQ + O | KRAFT/ AQ + $O_m$ |
|---|---|---|---|
| OZONE APPLICATION OF 0.5% TO EACH CASE | | | |
| K No. | 6.2 | 3.4 | 1.8 |
| VISCOSITY (cps) | 12.1 | 11 | 10.1 |
| PROPERTIES AND OZONE APPLICATION AT TARGET K No. of 3.5 | | | |
| Ozone (%) | 1.0 | 0.5 | 0.29 |
| VISCOSITY (cps) | 8.9 | 11 | 11.8 |

EXAMPLE 13

Southern softwood, i.e., loblolly pine, was bleached to target brightness of 83 GEB using the conventional CEDED sequence as shown in Table XXVI, using the conventional OC/DED sequence as shown in Tables II and III above and using the $OZ_mED$ sequence as shown in Tables IV and V above. Wood based dirt was refined and added to the $OZ_mED$ starting brownstock at a level of 0.75% by weight to examine the ability of this sequence to remove dirt compared to CEDED and OC/DED bleaching. Dirt properties of the three sequences, measured as Effective Black Area, bark and shives, were equivalent.

EXAMPLE 14

This example illustrates the range of applicability of the ozone bleaching process of the invention. Bleached pulps can be produced over a wide range of product brightnesses, utilizing appropriate combinations of ozone and chlorine dioxide charges to minimize environmental impacts and operating costs. As shown in Table XXX below, products having brightness from above 65% GEB can be produced by various combinations of ozone and chlorine dioxide while retaining reasonable strength properties.

While it is apparent that the invention herein disclosed is well calculated to fulfill the objectives stated above, it will be appreciated that numerous modifications and embodiments may be devised by those skilled in the art, and it is intended that the appended claims cover all such modifications and embodiments as fall within the true spirit and scope of the present invention.

We claim:

1. A process for the manufacture of a bleached pulp having a certain GE brightness and a certain strength as indicated by a certain viscosity which comprises:

chemically digesting a lignocellulosic material to initially form a pulp;

oxygen delignifying the pulp to remove a substantial portion of the lignin therefrom, with the combination of the digesting and oxygen delignifying steps being conducted to form an intermediate pulp having a specified amount of lignin and a specified viscosity;

treating the pulp at a pH of about 1 to 4 with a chelating agent to complex metal ions in the pulp and render such ions substantially non-reactive to ozone; and bleaching the treated pulp with a gaseous mixture that contains ozone by adjusting the consistency of the pulp to a high consistency of above about 28%, adjusting the pH of the pulp to below about 4, and treating the pulp with an amount of the ozone containing gaseous mixture sufficient to remove a substantial portion, but not all, of the lignin of the pulp by intimately contacting and turbulently mixing the pulp particles with the gaseous mixture in a dynamic reaction zone by introducing the high consistency pulp into the reaction zone to fill the zone to at least about 10% by volume, dispersing the pulp substantially completely throughout the reaction zone while simultaneously conveying the pulp therethrough in a plug flow-like manner at a dispersion index of about 7 or less thus exposing substantially all of the pulp to the ozone for reaction therewith for a sufficient time and at a temperature sufficient to allow access of the ozone to substantially all of the pulp for reaction therewith while the pulp advances through substantially all of the reaction zone, thus obtaining substantially uniform delignification of a significant portion of the pulp and forming a delignified pulp having a reduced amount of lignin and a certain strength, viscosity and GE brightness;

wherein the specified amount of lignin of the intermediate pulp is such that, after ozone delignification, the delignified pulp attains the certain GE brightness, and wherein the specified viscosity of the intermediate pulp is sufficiently high to permit the delignified pulp, after ozone delignification, to attain the certain strength as evidenced by the certain viscosity.

TABLE XXX $OZ_MED$ BLEACHING CONDITIONS

| STEP | CHEMICAL (%) | pH | TEMP. (°C.) | TIME (min.) | PULP CON. (%) | GEB (%) | K NO. (40 ml) | VISCOSITY* (cps.) |
|---|---|---|---|---|---|---|---|---|
| $O_m$ | [Conditions given in Table XIII] | | | | | 40 | 8.5 | 12.5 |
| $Z_m$ | 0.43 | 2 | 22 | 1.5 | 43 | 50 | — | 10 |
| E | 1.5 | 11.5 | 70 | 60 | 12 | — | — | 9.8 |
| D | 0.5 | 4 to 5 | 70 | 180 | 12 | 65 | — | 9.6 |
| | 0.7 | | | | | 70 | | 9.6 |

*Viscosity values after the $O_m$ stage are interpolated values based on established data.

2. The process of claim 1 which further comprises selecting the chelating agent to be a polycarboxylic acid, a polycarboxylate or a derivative thereof.

3. The process of claim 1 which further comprises selecting the chelating agent to be DPTA, EDTA or oxalic acid.

4. The process of claim 1 which further comprises bleaching the ozone delignified pulp with a peroxide.

5. The process of claim 1 which further comprises bleaching the treated pulp with ozone at a pH of between about 1 and 4.

6. The process of claim 1 which further comprises forming the pulp by Kraft pulping, Kraft-AQ pulping or extended delignification of a lignocellulosic material.

7. The process of claim 6 wherein the pulp is delignified with oxygen in a high consistency oxygen delignification step prior to treatment of the pulp with the chelating agent.

8. The process of claim 7 which further comprises conducting the oxygen delignification step by reducing the consistency of the pulp, substantially uniformly combining the reduced consistency pulp with an alkaline material, increasing the consistency of the pulp.

9. The process of claim 8 which comprises further bleaching the ozone delignified pulp to increase the brightness thereof.

10. The process of claim 9 wherein the ozone delignified pulp is treated with alkaline material prior to the further bleaching step.

11. The process of claim 10 wherein the pulp is treated with alkaline material to solubilize a portion of the lignin which remains in the pulp and which further comprises extracting a portion of the solubilized lignin to thus remove it from the pulp.

12. The process of claim 11 which further comprises comminuting the pulp particles prior to the ozone bleaching step.

13. A process for delignifying and bleaching a cellulosic material which comprises:

chemically digesting a lignocellulosic material to initially form a pulp;

oxygen delignifying the pulp to remove a substantial portion of the lignin therefrom, with the combination of the digesting and oxygen delignifying steps being conducted to form an intermediate pulp having a K No. of about 10 and a viscosity of at least about 13 cps;

treating the pulp at a pH of about 1 to 4 with a chelating agent to complex metal ions in the pulp and render such ions substantially non-reactive to ozone;

ozone delignifying the intermediate pulp with a gaseous mixtures that contains ozone by adjusting the consistency of the pulp to a high consistency of above about 28%, forming discrete pulp particles of a size having a sufficiently small diameter to facilitate substantially complete penetration of a majority of the particles by ozone gas, and treating the pulp with an amount of the ozone containing gaseous mixture sufficient to remove a substantial portion, but not all, of the remaining lignin by intimately contacting and turbulently mixing the pulp particles with the gaseous mixture in a dynamic reaction zone for a sufficient time and at a temperature sufficient to allow access of the ozone to substantially all of the pulp for reaction therewith while the pulp advances through substantially all of the reaction zone, thus obtaining substantially uniform delignification of a significant portion of the pulp and forming a delignified pulp having a K No. of about 5 or less, a viscosity of greater than about 10 cps, and a substantially uniform GE brightness of at least about 50%;

treating the ozone delignified pulp with alkaline material to solubilize a portion of the lignin which remains in the pulp and extracting a portion of the solubilized lignin to form a substantially lignin-free pulp; and increasing the GE brightness of the substantially lignin-free pulp to at least about 70% by subjecting the pulp to a bleaching step.

14. The process of claim 13 wherein the GE brightness of the substantially lignin-free pulp is increased to at least about 80% by bleaching with chlorine dioxide or a peroxide compound.

15. The process of claim 13 which further comprises selecting the chelating agent to be a polycarboxylic acid, a polycarboxylate or a derivative thereof.

16. The process of claim 13 which further comprises selecting the chelating agent to be DPTA, EDTA or oxalic acid.

17. The process of claim 13 wherein the bleaching step includes bleaching the pulp with a peroxide.

18. The process of claim 13 which further comprises delignifying the treated pulp with ozone at a pH of between about 1 and 4.

19. The process of claim 13, which further comprises forming the pulp by Kraft pulping, Kraft-AQ pulping or extended delignification of a lignocellulosic material.

20. The process of claim 19 wherein the pulp is delignified with oxygen in a high consistency oxygen delignification step prior to treatment of the pulp with the chelating agent.

21. The process of claim 20 which further comprises conducting the oxygen delignification step by reducing the consistency of the pulp, substantially uniformly combining the reduced consistency pulp with an alkaline material, increasing the consistency of the pulp and treating the increased consistency pulp with oxygen under conditions effective to promote delignification thereof.

22. The process of claim 21 which further comprises increasing the consistency of the pulp prior to ozone delignification.

* * * * *

UNITED STATES PATENT AND TRADEMARK OFFICE

CERTIFICATE OF CORRECTION

PATENT NO. : 5,441,603

DATED : August 15, 1995

INVENTOR(S) : Bruce F. Griggs, Thomas P. Gandek, Michael A. Pikulin, and Allen Rosen It is certified that error appears in the above-identified patent and that said Letters Patent is hereby corrected as shown below:

On the title page, item [63] on the first page, change "May 2, 1990" to --May 17, 1990--.

Signed and Sealed this

Twelfth Day of December, 1995

*Attest:*

Bruce Lehman

BRUCE LEHMAN

*Attesting Officer*

*Commissioner of Patents and Trademarks*